US005489918A

United States Patent [19]

Mosier

[11] Patent Number: 5,489,918

[45] Date of Patent: Feb. 6, 1996

[54] METHOD AND APPARATUS FOR DYNAMICALLY AND ADJUSTABLY GENERATING ACTIVE MATRIX LIQUID CRYSTAL DISPLAY GRAY LEVEL VOLTAGES

[75] Inventor: Donald E. Mosier, Cedar Rapids, Iowa

[73] Assignee: Rockwell International Corporation, Seal Beach, Calif.

[21] Appl. No.: 25,908

[22] Filed: Mar. 3, 1993

Related U.S. Application Data

[63] Continuation of Ser. No. 716,030, Jun. 14, 1991, abandoned.

[51] Int. Cl.[6] ..... G09G 3/36

[52] U.S. Cl. ..... 345/89; 345/147; 345/101

[58] Field of Search ..... 340/784, 793, 340/805; 345/87, 88, 89, 90, 92, 94, 95, 98, 99, 100, 101, 147, 148, 149

[56] References Cited

U.S. PATENT DOCUMENTS

| | | | |
|---|---|---|---|
| 3,955,187 | 5/1976 | Bigelow | 340/324 |
| 4,281,324 | 7/1981 | Nonomura et al. | 340/784 |
| 4,430,748 | 2/1984 | Tuhro et al. | 340/793 |
| 4,448,490 | 5/1984 | Shibuya et al. | 350/335 |
| 4,675,667 | 6/1987 | Nakamura et al. | 340/805 |
| 4,688,031 | 8/1987 | Haggarty | 340/793 |
| 4,788,588 | 11/1988 | Tomita | 340/784 X |
| 4,803,464 | 3/1989 | Holmes et al. | 340/793 X |
| 4,902,105 | 2/1990 | Welzen et al. | 350/346 |
| 4,925,277 | 5/1990 | Inaba | 350/350 |
| 5,034,734 | 7/1991 | Iguchi | 340/784 |
| 5,089,810 | 2/1992 | Shapiro et al. | 340/793 |
| 5,157,386 | 10/1992 | Uchida et al. | 340/793 |
| 5,170,155 | 12/1992 | Plus et al. | 340/805 |
| 5,266,936 | 11/1993 | Saitoh | 345/89 |

FOREIGN PATENT DOCUMENTS

| | | | |
|---|---|---|---|
| 0313331 | 4/1989 | European Pat. Off. | 340/784 |
| 0384403 | 8/1990 | European Pat. Off. | 340/784 |
| 2846874 | 10/1978 | Germany . | |
| 57-115401 | 7/1982 | Japan . | |
| 2217088 | 4/1988 | United Kingdom . | |

*Primary Examiner*—Howard W. Britton
*Assistant Examiner*—Kara A. Farnandez
*Attorney, Agent, or Firm*—Gregory G. Williams; M. Lee Murrah; G. A. Montanye

[57] ABSTRACT

A system for customizing the ramp voltage pulses used to drive an active matrix liquid crystal display. The customized ramp voltage compensates for brightness problems associated with any number of parameters. The V (ramp) also can allow for customized dimming of portions of the display. The standard V (ramp) is replaced with a variable wave form correlated to the timing of the driving of the LCD. The wave form can compensate for changes in brightness caused by off axis viewing angle or can compensate for brightness changes caused by temperature. Also, the system is directed to spatially modulating brightness of pixels for an active matrix LCD to correct color or brightness problems. A driving voltage wave form, which is varied as a function of location on LCD and grey scale is generated to cause selected sets of pixels to be adjusted from an instructed grey scale. Sets of grey scale values are selected to cause the optical characteristics of the display to produce correct color or uniform brightness regardless of the viewing angle.

30 Claims, 8 Drawing Sheets

START Y
CLOCK Y
ROW 1
ROW 2
ROW 3
ROW M
LOAD ROW 1
LOAD ROW 2
LOAD ROW 3
10-15 μSEC
(60-80 TIMES/SEC)

82
$V_{RAMP}$ (PRIOR ART)
CLOCK
16 PULSES
CLEAR
COLUMN LINK
GRAY SCALE 8
GRAY SCALE 2
GRAY SCALE 15
98
$V_{RAMP}$ (INVENTION)

$V_1$= VOLTAGE USED FOR THE WHITE LEVEL
$V_2$= VOLTAGE USED FOR THE BLACK LEVEL

METHOD AND APPARATUS FOR DYNAMICALLY AND ADJUSTABLY GENERATING ACTIVE MATRIX LIQUID CRYSTAL DISPLAY GRAY LEVEL VOLTAGES

This application is a Continuation of application Ser. No. 07/716,030 filed Jun. 14, 1991, now abandoned.

BACKGROUND OF INVENTION

Field of Invention

The present invention relates to liquid crystal displays, and particularly to how gray level voltages are generated for active matrix liquid crystal displays to adjust or compensate for brightness and color variations, whether instructed or caused by operating conditions.

A. Problems in the Art

1. Basic LCD structure and operation

There are several types of liquid crystal displays (LCDs). The general concept of operation of liquid crystal displays is the same for all types. A liquid crystal material is placed in a sealed but light transmissive chamber. Light-transmissive electrodes are placed above and below the liquid crystal material. In one type of LCD utilizing what are called twisted nematic liquid crystals, when a sufficient electric potential is applied between the electrodes, the liquid crystal molecules change their alignment. The change in alignment alters the polarization state of light through the liquid crystal material. The chamber or cell essentially acts as a light shutter or valve. It lets either a maximum or minimum of light through; or some intermediate level.

Therefore, by putting the liquid crystal chambers on top of a polarized back-lighting source, and locating a polarizer above the LC chamber, the top of the liquid crystal chamber will look either black (dim) or white (bright) depending on the alignment of the material (whether the valve is "closed" or "open"). By using a collection of these chambers, such things as letters, numbers, or graphics can be formed by applying appropriate voltage potential across certain chambers which instruct the appropriate cells to pass or block light, to in turn form the appropriate visual pattern.

2. Segmented LCDs

Many watches utilize liquid crystal displays. Some advantages of LCD's for watches include the small amount of space required by the display and the circuitry driving it, as well as the low power consumption generally required. Watches generally use what is called segmented LCD structure. Seven segments or chambers of liquid crystal material can be arranged into a template or pattern which can form any numeral (and virtually any letter). Each segment is then controlled to simply turn "on" or "off"; that is, transmit maximum light (appears brighter or white) or not (appears dim or black). The appropriate segments are turned "black" to form the desired numeral if a "normally white" background is used. It is to be understood that depending on design choice, the background of liquid display can either be normally black or normally white.

3. Matrix LCDs

The advantage of a segmented display for watches is the simplicity of the display and associated structure. Only a few segments must be operated to form each number. Also, the segments usually must be driven to be fully on or fully off. This simplifies the electrical structure needed to drive and control the LCD.

For more complex displays, a matrix LCD structure is normally utilized. A large number of very small independent regions of liquid crystal material are positioned in a plane. Each of these regions is generally called a picture element or pixel. These pixels are arranged in rows and columns forming a matrix. Corresponding numbers of column and row electrodes are correlated with the rows and columns of pixels. An electric potential can therefore be applied to any pixel by the selection of appropriate row and column electrodes and a desired graphic can then be generated.

There are different types of matrix LCD structures. Some are considered "active matrix" LCD's; others are called "passive matrix" LCD's. The present invention is related primarily to active matrix LCD's and therefore this discussion shall concentrate primarily on that form of LCD.

An active matrix LCD operates in an analogous way to other video-type displays. The individual pixels comprise dots or small portions of the overall picture or graphic to be displayed. A graphic control therefore produces the appropriate instructions to "drive" the matrix of pixels to appropriately reconstruct the image desired. In other words, the control circuitry must send appropriate voltages to appropriate pixels at appropriate times to form the correct image.

This is a complex process. If the LCD is used as a television screen, for example, the image constantly changes. Similarly to conventional cathode ray tube (CRT) televisions which scan an electron beam across successive rows of pixels, the matrix of LCD pixels is generally scanned at many times per second (for example, 20 times per second) by parallely charging pixels in successive rows of the display to continually update the composite picture. In some displays the graphics are created by turning selected pixels "black" and leaving the others "white". By varying the density of black pixels, shades of gray can be somewhat simulated. The driving circuitry only has to turn pixels fully "on" or fully "off". For many applications it is also desirable that each pixel not only must be able to turn completely "on" and "off" (that is the states of "black" or "white"); it must also be able to have varying degrees of transmissibility between totally black and totally white. An individual pixel can then be black, white, or different shades of gray in-between.

This is called the gray scale ability of a pixel. To provide gray scale, the control circuitry must be able to supply varying levels of voltage potential to each pixel. The voltage is correlated to each succeeding darker shade of gray. As is well known in the art, gray scale voltages for a particular LCD are determined from the type of liquid crystal material used, the spacing of the electrodes, and other factors. In other words, it can be determined what different levels of voltage will cause what different transmissibilities of the pixel to occur. Once this is known, the control circuitry can issue appropriate instructions to request the appropriate gray levels to replicate the input signal (for example the video signal). The circuitry then must also generate the actual voltages correlated to the instructed gray scale levels.

It can therefore be understood that if the pixel size is sufficiently small, and the size of the matrix is sufficiently large complex graphics with high resolution can be displayed.

4. Color LCDs

Television pictures, and even color television, can be replicated on matrix LCDs; as can virtually any graphic. Color is created by placing blue, green, and red filters over selected pixels, generally in a repeating pattern across the display (for example, delta-triad, diagonal mosaic, or quad patterns). The graphics control for the LCD would then instruct the correct combination of activation of red, blue, and/or green pixels, in addition to the correct gray scale for each pixel behind the red, green, or blue filters. Although the LCD-actually displays a matrix of discrete red, blue, and green filtered pixels driven to varying transmissities (gray levels), the human eye would then "average" closely spaced positions of the screen. Instead of seeing individually lighted red, blue or green pixels, the viewer would perceive regions of colors along the whole range of the color spectrum. For example, the human eye will average a green and red side-by-side pixel combination to be the color yellow, if the intensities or brightness of the green and red LCDs are essentially the same. This concept is well known in the art.

5. Advantage of LCDs

The use of LCD's is becoming more wide spread for at least the following reasons. As mentioned above, they require relatively low power consumption, at least as compared to cathode ray tubes (CRT's). Liquid crystal technology is becoming more advanced, which in turn allows better pixel performance and better resolution. A substantial benefit is the fact that the technology of LCD's allows the dimensional depth of a LCD display and its associated circuitry to be much less than CRT's. Moreover, the weight of a LCD is much less than a CRT of comparable size. Still further, from a safety standpoint, most LCD's eliminate the risk of the presence of high voltage (up to several thousand volts with CRT's) and other problems associated with CRT technology.

6. Deficiencies and problems with existing LCD's

While the advantages of LCD's sound encouraging, several problems do exist with LCD's which are related to their physical makeup. As discussed above, a liquid crystal pixel can be driven to white, black, or an intermediate gray scale level by altering the transmissibility of the light through the pixel by using correlated gray scale drive voltages. Thus, the optical characteristics of LCD's are such that if a viewer is looking directly normal (on-axis) to a pixel or a collection of pixels, and the pixel or a collection of pixels is appropriately driven, the image created by the pixel or collection of pixels will have uniform intended contrast with the background (or alternatively an uniform brightness). However, if a viewer's line of sight moves substantially off-axis (for example more than a few degrees), the optical characteristics change with respect to that location even though the driving voltage remains the same.

In simple terms, a change in viewing angle can significantly change how well the images can be seen from that angle. An easy example of this phenomenon is to take a LCD watch and view the display straight on (on-axis). Because the display is small and flat, all numbers or characters and all parts of the screen look fairly clear and consistently distinct across the display. In other words, the numbers are "bright" (dark black on a white background, or white on a dark black background). However, if you angularly tilt the watch display to a severe angle with respect to your eyes, the characters on the display become much less distinct and can virtually disappear (i.e., the brightness contrast between numbers and background degrades). This can occur at both vertical or horizontal off-axis viewing angles. Vertical angles tend to cause more problems however.

A significant problem therefore exists in the lack of consistency of sharpness, clarity, or distinctness of graphics displayed on a LCD as a function of viewing angle. This may not be very significant with a LCD watch, because the user can easily either maneuver the watch or the user's head to a position generally normal to the display surface and because the watch does not use intermediate gray shades. It can, however, be a substantial and even critical problem in such LCD uses as, for example, control instrumentation where consistent and accurate viewing is essential. As can be appreciated for a large LCD, the viewing angle of the viewer's eyes between the top of the screen and the bottom of the screen can even cause different parts of the screen to vary.

Another problem or concern with LCD's is the fact that performance of the display can vary as a function of temperature of the display. Ambient temperature variations or internal temperature rises due to back-light power dissipation change the panel temperature, which in turn affects the performance of the liquid crystal or the electronic components. The result can be the loss of contrast between pixels which are supposed to be at a gray level distinct from the background. This again relates to what is called "brightness" of the images versus the background.

Still further, a deficiency in the art exists with respect to the ability to selectively vary brightness or contrast of certain portions of the display (foreground vs. back-ground). Normally, if the entire display needs to be dimmed, the art generally utilizes a control to simply change the background illumination to the entire display. However, there are occasions and needs where it would be advantageous to dim or to brighten selected portions of the LCD.

7. Example of deficiencies and problems with aircraft instrumentation

A specific example of how these problems affect real world situations is to consider the utilization of LCD's on instrumentation in aircraft. Currently either analog electromechanical instrumentation or CRT displays are generally used for certain primary flight instruments. Many of these instruments require a screen of several inches in diameter. They would also be placed in a control panel anywhere from several inches to several feet away from the pilot's eyes. Some of the instrumentation would be positioned at the copilot's position, but still require viewing by the pilot.

Although the control panel is generally configured to present favorable viewing orientation for the pilot and copilot, the angle of view both horizontally and vertically for all gauges cannot be directly perpendicular or normal (on-axis) to the pilot's eyes for all instrument displays, or at least for all portions of a display. Therefore, the viewing angle problem is significant. It is easily understood how lack of contrast (brightness) on an instrument or a gauge display in an airplane, to the point where the pilot cannot easily comprehend the information on the instrument or gauge, can be a significant problem; and even a dangerous problem.

Moreover, continual operation of this instrumentation over a variety of lengths of time, altitudes, ambient air temperatures, etc., can affect the operational temperature of the LCD's. This in turn can affect the optical performance of a LCD as previously described.

Still further, it is desirable in some of the complex instruments and displays for commercial aircraft that certain portions of the display be independently dimmed or brightened. An example is the ability to bring up a brightened radar display graphic on a portion of the same display that other information is being displayed. It is essential that this radar image also be able to be removed or at least dimmed on command when desired so that the other information can be clear and distinct.

It can therefore easily be seen that substantial problems and deficiencies exist in the LCD art. A real need exists in the art to solve or at least improve the ability to deal with these problems and deficiencies.

It has also become apparent that the viewing angle problems associated with LCDs can materially affect color rendition of LCDs using colored filters over the pixels to reproduce color graphics. This problem is significant because it not only affects color rendition, but could also affect the perception of what type of information is being displayed on the LCD. For example, an airplane gauge or instrument may use color coding for certain symbols or areas of display. Pilot becomes accustomed to perceiving a certain color for a certain condition. If the viewing angle is severe enough, a display portion can actually change colors. This can represent a dangerous situation.

The problem is caused by the same factors causing brightness variations as previously discussed. As off-axis viewing angle increases, brightness of the pixel will change from the brightness when viewed straight on-axis. This changes the perceived gray scale level of the pixel. If the color filter is positioned over the pixel, this will affect the intensity or luminance of the pixel. As is known in the art, colors are generated in LCD displays by clustering red, blue, and green color filtered LCDs in repeating patterns across the display. Different colors can be created in different locations in the screen by turning individual blue, green, red pixels onto different intensities. The human eye averages individual luminance or intensities of each colored pixel and constructs a shade of color according to those different intensities.

For example, to produce a purely red field, all the green and blue pixels are driven completely "black" (to basically turn them black or to block any light transmitting through the pixel). All the red LCDs are driven "white" (the back light then goes through the LCD and the red filter and the eye perceives the field as red). Likewise, blue or green fields can be created following a similar analysis.

If a different shade for the field is desired, combinations of these three colored pixels are utilized. For example, if red and blue pixels are driven transmissive to allow light to transmit through those respective filters at uniform intensities, and the green pixels are driven "black", the field would have a magenta color, which is a mixture of blue and red. If the entire field is desired to be white, all pixels are driven "white" and light transmits through all three different colored filters across the field. The human eye averages that out as white (a combination of all primary colors). If the field is desired to be black, all LCDs are turned "black" which disallows any transmission of light through any of the colored filters (black being the absence of colors).

Still further, a combination of transmission of the same intensity through the green and red filters while blocking the blue filters would create a yellow color. By varying the intensity of either the green or the red pixels to allow more transmission between either one, the shade of yellow can be adjusted anywhere from almost red (orange) to almost green (lime green). As can therefore be understood, by varying which LCD pixels are allowed to transmit light, and at what intensity, virtually any color can be replicated, if the pixels are small enough. The human eye simply averages out the composite light output and constructs color on basis of this averaging. Because different viewing angles change the received intensity of various pixels, color rendition is changed from that intended and received when viewed straight on-axis. No adequate solution has been created for this situation.

Moreover, the off-axis angle viewing problems actually vary over the range of viewing angles that can exist for a particular LCD. In other words, in an airplane cockpit, a LCD may be tilted at 30° from vertical. However, the position of the pilot's eyes also creates a situation where the top of the LCD presents a different angle than the bottom of the LCD. Therefore, contrast problems and color rendition problems may not be the same for the entire LCD, and have to be approached differently for different segments of the LCD.

It is therefore a principal object of the present invention to provide a method and apparatus for dynamically and adjustably generating liquid crystal display gray level voltages which solve or overcome the problems and deficiencies in the art.

A further object of the present invention is to provide a method and apparatus as above described which effectively and flexibly allows generation of gray level voltages.

A still further object of this present invention is to provide a method and apparatus for generating gray level voltages which can compensate for a variety of different factors associated with the performance of the LCD.

Another object of the present invention is to provide a method and apparatus as above described which has the ability to compensate for both non,time varying and the time varying factors which affect the overall performance of a LCD.

Another object of the present invention is to provide a method and apparatus as above described which allows the generation of variable gray level voltages.

A still further object of the present invention is to provide method and apparatus as above described which can compensate for off-axis viewing angles, temperature variations, and other factors unique to a particular operation and position of a LCD.

Another object of the present invention is to provide a method and apparatus as above described which can compensate for discretionary factors such as dimming or brightening of certain portions of the display.

Another object of the present invention is to provide a method and apparatus as above described which generates stable but variable gray level voltages.

A still further object of the present invention is to provide a method and apparatus as above described which is effective and reliable for a variety of different situations.

Another object of the present invention is to provide a method and apparatus for complimentary spatial modulation for off-axis LCD color and brightness control which solves or overcomes the problems and deficiencies in the art.

Another object of the present invention is to provide a method and apparatus as above described which can correct color rendition problems or brightness control problems for an LCD.

Another object of the present invention is to provide a method and apparatus as above described which can compensate for loss of color or contrast caused by viewing angle or other factors.

A still further object of the present invention is to provide method and apparatus as above described which can compensate for both non-time varying and time varying factors which affect color or brightness of the LCD.

Another object of the present invention is to provide a method and apparatus as above described which can adjust all or portions of the LCD.

A still further object of the present invention is to provide method and apparatus as above described which is economical, efficient, and durable.

These and other objects, features, and advantages of the present invention will become more apparent with reference to the accompanying specification and claims.

SUMMARY OF INVENTION

The present invention includes an apparatus and method for varying the drive voltage for an active matrix LCD to accommodate different display options and to compensate for a variety of operational factors which degrade display performance. The invention generates a drive voltage wave form which is correlated to the required timing of operation of the LCD and related circuitry. This variable wave form is substituted for a non-variable driving wave form from which the gray scale levels for the entire display are selected.

The method of the invention generates the time-varying wave form from which gray scale levels can be selected. The wave form is varied, however, according to whether the gray scale level(s) which is/are instructed to be produced for a particular pixel or section of pixels should be adjusted or compensated. The adjustment or compensation is controlled by customizing the voltage wave form either by prior knowledge of an operational characteristic of the LCD (such as for example, viewing angle), by monitoring changes in operation (for example, temperature) or by manual control (for example, dimming or brightness level for a portion of the screen).

Additionally, if viewing angle is such that it will affect perceived color of an area of the display, the voltage wave form is customized according to what changes in driving voltage are required to compensate for this problem. Similarly, for brightness or contrast problems which exist in any portion of the LCD, a similar solution is provided.

Normal control circuitry for an active matrix LCD issues gray scale instructions to the LCD. The circuitry also generates a repeating, non-changing linear ramp voltage wave form correlated to those gray scale instructions. The method of the present invention would dynamically and adjustably generate driving voltage wave forms that may differ from the linear-type ramp to solve the particular problem which could affect the visual clarity of the LCD from the particular vantage point of the user.

In effect, the present invention substitutes a gray scale voltage signal for that normally utilized by the LCD to compensate for such things as viewing angle problems, temperature problems, or requested dimming or brightness instructions portions of the display.

The apparatus of the invention includes means for generating the actual driving voltage wave form, means for instructing how the wave form should be constructed, and input means for providing the information needed to construct the appropriate wave forms. The apparatus also includes means for coordinating timing of the wave form to correlate to operation timing of the LCD.

The apparatus of the invention is added to the existing display control circuitry for the LCD and substitutes its customizable driving voltage wave for that normally generated by the circuitry.

The invention can accommodate a wide variety of parameters to control, adjust, and vary the output voltage driving wave form. For example, information from other transducers, sensors, or sources can be input to the invention, which like temperature, would automatically vary the wave form, and therefore accommodate the LCD, according to that monitoring. Still further, a variety of areas on the display could be selectively dimmed or brightened with the appropriate controls. Other uses, enhancements, and alternatives are also possible with the invention.

Another aspect of the present invention is to compensate for some of these problems by spatially modulating driving of the pixels of the LCD. If, for example, a certain portion of the LCD is desired to be red, but it is known that the region will be viewed from an off-axis viewing angle, it will therefore be understood that even though the pixels are correctly driven to make the field look red when viewed on-axis, off-axis viewing angles normally cause the eye to perceive something other than distinct red. Depending on the angle and the performance of the particular LCD, the field could either be diminished so that red is barely seen, the whole field could turn a shade of gray, or it could even turn to a complimentary color from red, namely blue/green or cyan.

Information can be derived as to how the viewing angle affects the perception of color. A driving voltage for pixels at different locations could then be altered so that some are driven above the instructed voltage, and others are driven below the instructed voltage so that the brightness of the pixels, as averaged by the human eye, would achieve the brightness required so that the eye would perceive a field of red. Therefore, the LCD is spatially modulated in the sense that various pixels in different spatial locations on the display are intentionally varied in intensity by customizing the driving RAMP voltage used to create voltage potential at pixels (the modulation).

A still further aspect of the invention is the use of what will be called complimentary spatial modulation. Drive voltages are used which have response characteristics complimentary to the color desired to be displayed. In other words, to avoid the viewer seeing a color reversal to a complimentary color (normally at severe off-axis angles), the invention drives pixels in a spatially modulated form to operate different sets of pixels at different drive voltages so that the average perceived brightness of the area of the display produces the correct color.

It is to be further understood that this type of spatial modulation works for either complimentary color compensation, or even for maintaining uniform brightness or the integrity of a certain color for a portion of the screen to the extent possible. For example, it is difficult to select a single drive voltage to produce a dark black perceived color at pixels for all viewing angles. If one driving voltage to produce "black" pixels is utilized, it may be sufficient for one viewing angle, but produce only a gray shade at many other viewing angles. Therefore, the present invention also uses spatial modulation to drive pixels in an area that is to be black at different driving voltages so that the eye would average the pixels to "black" for most viewing angles.

DETAILED DESCRIPTION OF PREFERRED EMBODIMENT

A. Overview

Figure 1:
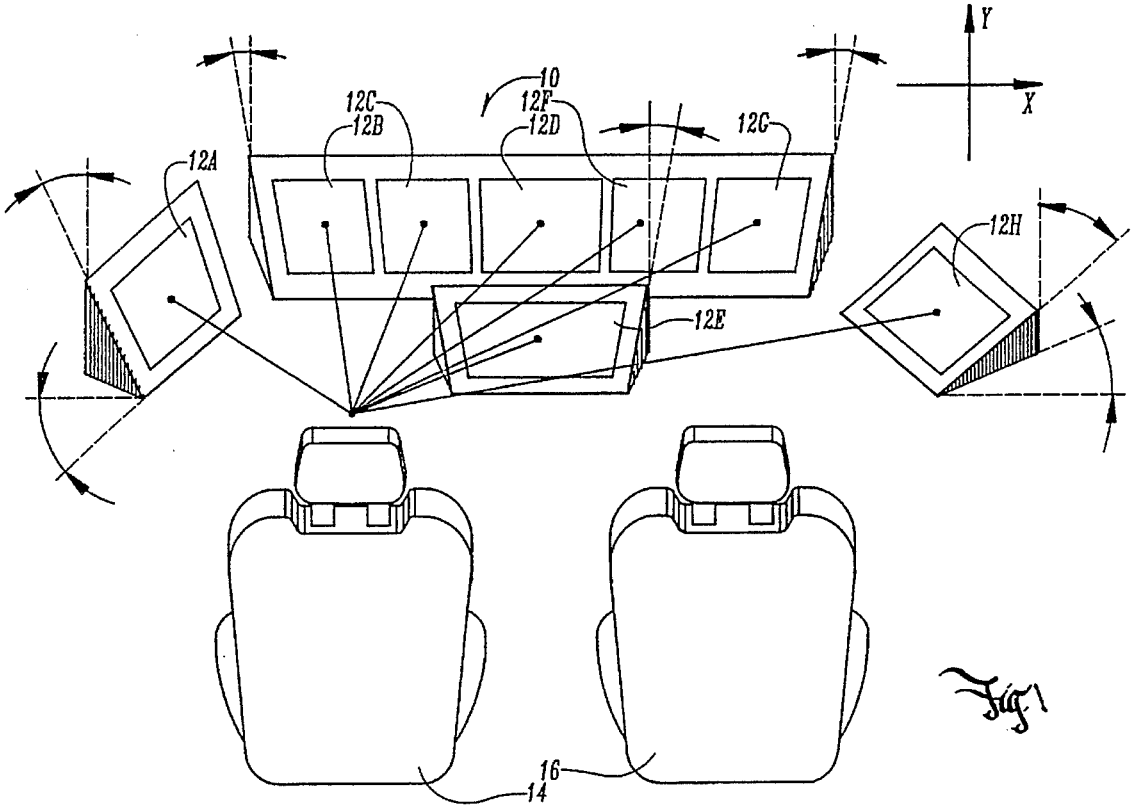
FIG. 1 is a diagrammatic perspective view of an airplane cockpit utilizing liquid crystal instrument displays and showing the different viewing angles for the pilot.

To assist in a better understanding of the invention, a preferred embodiment will now be described in detail. This is but one form the invention can take and does not limit the invention to a single form.

The accompanying drawings also form a part of this detailed description. Reference numerals are utilized in the drawings to indicate specific parts or locations in the drawings. The same reference numerals will be used throughout the drawings and this description to indicate the same or similar parts or locations, unless otherwise noted.

B. Structure and Operation of Active Matrix LCDs

To understand the invention, some familiarity is needed with regard to problems which exist in the art, the operation of LCD's, and the terminology utilized in this field. To illustrate these matters, this discussion will focus primarily on active matrix liquid crystal displays (AM LCD's). Also the discussion will focus on the use of these LCD's in airplane cockpit instrumentation. It is to be understood, however, that the invention can be applicable to a variety of different uses and types of LCDs. One example would be truck and railroad control or monitoring systems.

FIG. 1

By referring to FIG. 1, an airplane instrument panel is depicted. A variety of relatively large LCD's 12*a–h* (several inches square) are depicted. As can be appreciated from this drawing, pilot and copilot seats 14 and 16 present different horizontal and vertical viewing angles for different LCD's. In fact, each portion of each instrument 12*a–f* presents a different viewing angle. The top of LCD 12*d* presents a different vertical viewing angle than the bottom of LCD 12*d*. LCD's 12*a* and 12*h* are also rotated horizontally with respect to main instrument panel 10. LCD 12*e* has a still further different orientation to both the instrument panel 10 and pilot seats 14 and 16.

In short, this presents a variety of different viewing angles for the pilot. While the pilot can adjust his/her head or body to move around to get a somewhat different viewing angle for different LCD's 12, the pilot is somewhat limited in such movement. The pilot needs to be able to quickly and easily read any of the LCD's 12, even those over towards the copilot's seat 16.

FIG. 2

Figure 2:
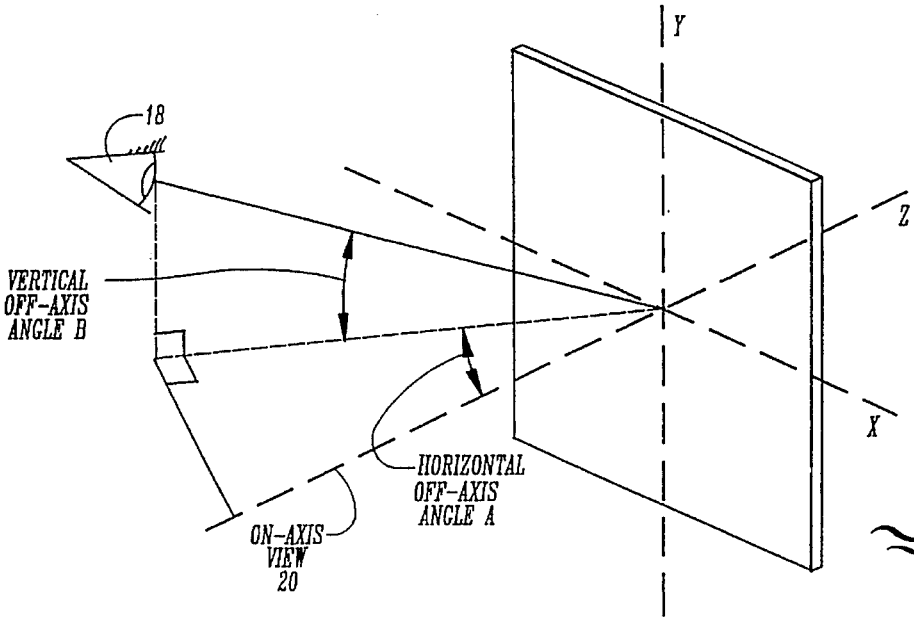
FIG. 2 is a diagrammatic presentation of one example of an off-axis viewing angle for a LCD; being off-axis both horizontally and vertically.

FIG. 2 in more simplified form depicts one LCD 12 with an x–y–z coordinate system associated with its display face. Pilot's eye 18 is illustrated and angles A and B illustrate that eye 18 is angularly oriented both vertically (angle B) and horizontally (angle A) in relationship to the XY coordinate system of LCD 12. In other words, the pilot's eye 18 is off-axis 20 both in vertical and horizontal directions. Eye 18 is not positioned normal to the x–y plane.

C. Relative Luminance Curves for Viewing Angles

FIG. 3

Figure 3:
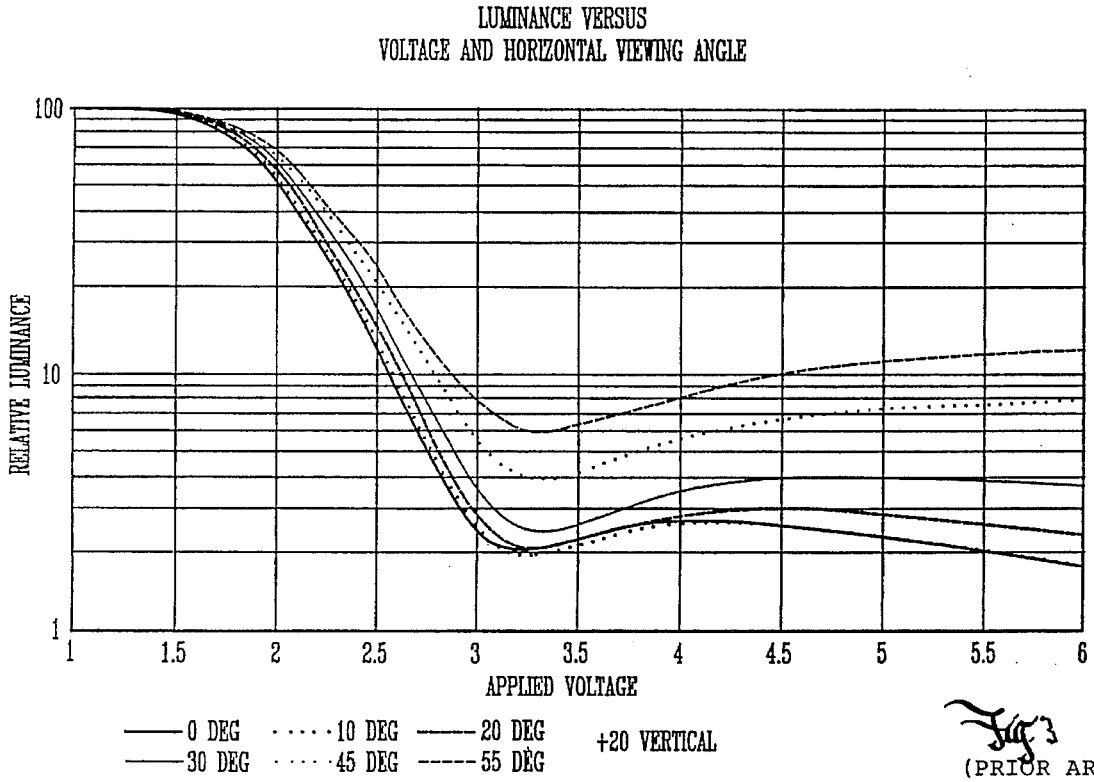
Fig 3 (PRIOR ART)
FIG. 3 is an example of a graph illustrating variance of luminance (brightness) for different applied driving voltages for a pixel of a LCD for various-horizontal viewing angles.

FIG. 3 is a plot of relative luminance (otherwise called brightness) versus applied voltage for different viewing angles for a hypothetical LCD 12. The graph of FIG. 3 is intended to show the type of variance which can occur in the brightness of a pixel for a given applied voltage when the viewer's position is 0°, 10°, 20°, 30°, 45°, and 55° angularly and horizontally from the LCD 12. It also assumes that the viewer has a positive 20° vertical viewing angle of the LCD 12 and assumes a normally white display.

FIG. 3 is meant to be representative only of the types of applied voltage versus relative luminance curves that can exist for active matrix LCDs. An understanding of these curves is important to an understanding of the present invention and therefore FIG. 3 will be discussed in some detail. It is also emphasized that in FIG. 3 the voltages are scaled equally along the abscissa, but that luminance is expressed in relative numbers in logarithmic scaling along the ordinant. This highlights the variation between the curves at the right side of FIG. 3, although variations exist between curves across the whole graph.

In this example, it is to be understood that between zero and 1.5 volts driving voltage, transmissivity of the pixel (that is, luminance or brightness) does not change substantially. It essentially remains completely transmissive, or looks bright. At approximately 1.5 volts the liquid crystal molecules begin to realign and affect the optical transmission of light through the pixel. Over the range of 1.5 volts to a little more than 3 volts, for this example, the pixel would essentially change from completely white transmissive and bright, to almost completely black; but only if the viewer is directly on-axis in front of the LCD 12.

As FIG. 3 shows the greater the horizontal angle of view for the viewer, the less black (the brighter) the pixel appears, even if three or more volts is applied. Essentially this means that at extreme horizontal viewing angles, the pixel can do no more than appear quite gray to the viewer. It is noted that even if more voltage is applied to make the pixel look darker, for higher viewing angles the pixel would actually begin getting lighter instead of grayer or blacker.

FIG. 3 therefore shows that the brightness (that is the state of the pixel between transmissive and non-transmissive) is proportionally controlled by the amount of voltage applied to the pixel when viewed within a few degrees of angle from on-axis. It furthermore shows that an off-axis viewing angle horizontally can materially affect brightness of the pixel at the user's eye. In a more general sense, this means that the intended state of brightness of pixels can change dramatically.

FIG. 4

Figure 4:
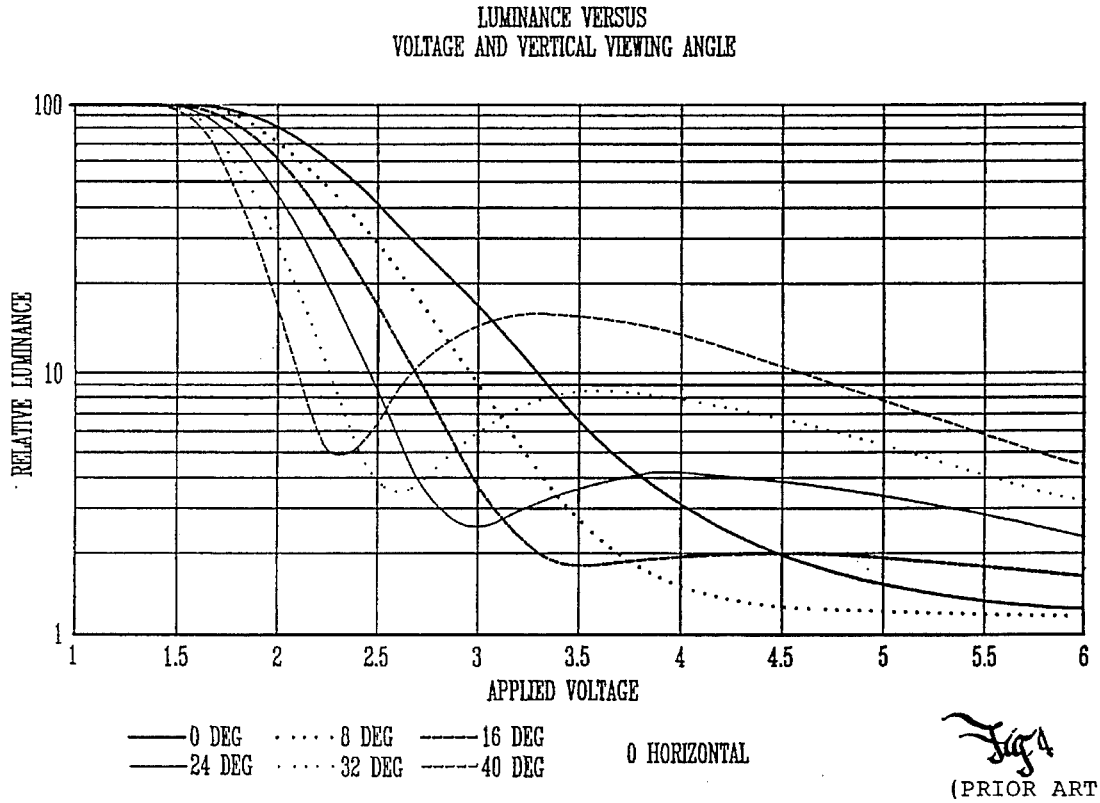
Fig 4 (PRIOR ART)
FIG. 4 is a graph similar to FIG. 3 except showing variance of luminance for vertical viewing angles.

FIG. 4 on the other hand illustrates a similar plot of brightness to applied voltage but for differing vertical (as opposed to horizontal) viewing angles. Note also that it assumes a normally white display and a 0° horizontal viewing angle (that is the viewer is aligned horizontally with the LCD 12). In this case, a pixel for an on-axis viewer is fully transmissive up until approximately 1.5 volts, and then somewhat linearly decreases in brightness until it becomes essentially non-transmissive or black at about 4.5 volts. If vertical viewing angle is increased, FIG. 4 shows that the brightness of the pixel for a particular applied voltage decreases for all viewing angles until a little over two volts applied voltage. Thereafter, for various viewing angles there is actually a reversal of brightness. For example, for a 40° vertical viewing angle, the pixel would appear much dimmer than on-axis viewing until 2.2 volts applied voltage. Thereafter it would then move back towards the 0° line until a little over three volts, where the pixel would actually then appear brighter than on-axis viewing. What this means is that with steep vertical viewing angles, a pixel driven to between two and 2.5 volts may look virtually black (when it is intended to be highly transmissive or very bright), but at 4.5 volts it would look somewhat transmissive (somewhat bright, when it is intended to be very black).

It can therefore be seen that the LCDs 12 in FIG. 1, each having different horizontal and vertical orientation to a pilot or a copilot, can have significant viewing problems. The LCD's 12 which are farthest away and most severely angled to the pilot can be virtually unreadable, or at least the contrast level is not sufficient or adequate for easy and reliable viewing and comprehension.

FIGS. 3 and 4 therefore illustrate that it is very difficult if not impossible, using known LCD systems, to present an image which will have uniform contrast across the entire screen for different horizontal and vertical viewing angles. It is again emphasized that FIGS. 3 and 4 are representative only and that various curves exist for different LCDs. These curves must be empirically derived. This can take weeks of man-hours, or if done automatically, even takes hours. These concepts are known within the art and the derivation of these curves is not novel. However, the understanding of how brightness varies with applied voltage, together with how brightness varies as a function of viewing angle, is of primary importance to understanding the operation of the invention.

Therefore, it must be understood that FIGS. 3 and 4 illustrate the following principles. FIG. 3, for example, shows an applied voltage of three volts will produce a relative luminance value of approximately 2.5 for 0° horizontal viewing angle. As horizontal viewing angle increases from 10° to 20° to 30° to 45° and to 55°, the human eye will perceive a relative luminance of that pixel not at a 2.5 value, but at 2.6, 3, 3.7, 5.4, and 8 values. Put another way, relative luminance at 55° viewing angle is much brighter than at 0°. This is critical because although the magnitude of brightness variation may not seem great, that much variation can materially effect the desired contrast between a pixel that is supposed to be dark, and one that is supposed to be lighter or more transmissive.

Still further, at voltages below 2.5, the difference in relative brightness between 0° and 55° can also be significant. A pixel which is supposed to be almost in between fully transmissive and fully non-transmissive at 2.25 volts, would appear much closer to fully transmissive at 55° horizontal angle.

FIG. 4 illustrates why vertical viewing angles present even more difficult problems. If three volts applied voltage is used as the example, it can be seen in this case that at 0° vertical viewing angle approximately an 18 relative luminance value is accomplished. As vertical viewing angle increases to 8°, 16° and 24°, perceived brightness decreases substantially through values of 9, 4, and 2.6. Therefore, at 24°, a viewer would see the pixel much dimmer or less bright than its 0°. An interesting thing then happens at 32° and 40° viewing angles at three volts applied voltage. The relative luminance actually starts increasing again to the values of 6 and 15. Therefore, at least at 40°, the relative luminance would be similar to that at 0°.

As a further example, at 2 volts applied voltage and 0° vertical orientation, 80 percent relative luminance is achieved. At 40°, however, that luminance drops to under 20. This therefore changes the transmissivity from relative 80 percent to 20 percent, which is almost the reverse of what was desired.

FIG. 4 also shows the interesting phenomenon of rebound of the curves. It can be seen for viewing angles of 16° and above that the curves actually reach bottom and then begin upward again and cross the 0° line. This means that at 2 volts and a 40° viewing angle, the pixel is much dimmer than at 0°. However, at 4.5 volts and 40°, the pixel is much brighter than at 0°.

The nature of these curves therefore illustrate how difficult it is to solve the viewing angle problem associated with LCDs. Even if a pixel were driven to only two values; namely, a low applied voltage to achieve high transmissivity, and a higher voltage to achieve minimum transmissivity, at different viewing angles, brightness or lack of brightness of the pixel can vary dramatically.

A still further issue and problem is illustrated by FIGS. 3 and 4. It is difficult to select an appropriate applied voltage to provide a minimum transmissivity level for a pixel for all viewing angles, both vertical and horizontal. FIG. 3 shows that 3 volts at 0° would provide virtually the lowest transmissivity for any horizontal viewing angle. However, 3 volts with respect to FIG. 4 shows a quite high level of transmissivity or brightness. Conversely, the farther to the right in FIG. 4 you would go, the lower transmissivity one would achieve, but for higher horizontal viewing angles, the more brightness variation would exist.

Not only must this analysis be applied to monochromatic LCDs, it becomes more complex when dealing with color LCDs. As is well known, a wide range of colors along the color spectrum can be produced by utilizing red, blue and green pixels evenly spaced out along the display. Colors are produced by putting red, blue and green filters over selected pixels. If a bright red color is desired for a portion of the screen, all the pixels having red filters are allowed to have maximum transmissivity so that the back lighting will, to the maximum allowable extent, pass through the filters and be perceived by the eye as red dots. In other words, the red pixels will be bright. Conversely, all blue and green pixels will be dimmed or the transmissivity will be decreased to a minimum. They will basically be black. The human eye will therefore perceive only the red light and average it as a completely red field.

Different colors can be made by varying the transmissivity through the red, blue and green filters to various extents. If all red, blue and green pixels are transmissive, the eye will perceive the background as white; that is a mixing of all color. If the pixels are driven to various in-between transmissivities, different colors can be created which are mixtures of the red, blue and green components.

FIG. 4 therefore further illustrates another problem encountered by virtue of the brightness variances for different viewing angles. To achieve a certain color, the ratio of brightness of the red, blue or green filter pixels must be fairly exact. If red pixels, for example, would be driven at a low voltage, in one example, and green and blue pixels at higher voltages, FIG. 4 shows that at higher and higher vertical viewing angles, even though it is desired that the red pixels be brighter than the blue or green, the relative brightnesses can actually reverse. Therefore, an additional problem of not only having less contrast between brighter and dimmer pixels can occur, but also the colors can change and even reverse. This can be a critical problem in airplane instrumentation as illustrated by the following example.

One possible display in the primary instrument group could be what is known as an earth/sky ball. A circle has one hemisphere colored blue indicating the sky, with the other hemisphere colored brown to represent the ground. The boundary between the two represents the horizon. As the plane turns, the ball in the horizon also turns to always give the pilot an orientation reference to the ground. Light blue and brown happen to be complimentary colors. Therefore, at high vertical viewing angles, if the brightnesses of the blue, green and red pixels that are used to form light blue and brown reverse, colors on the relative hemispheres could reverse. The pilot, trained to react quickly to instrumentation, may perceive the instrument to tell him that the airplane is at a drastically undesired orientation with respect to the earth and take action which could lead to disastrous results.

It is therefore to be understood that these problems are real and significant. The nature and magnitude of brightness variation for viewing angles can vary for a number of reasons. Again, however, this information can be empirically derived for a given LCD.

It should also be remembered that temperature affects operation of LCD's. Sufficient temperature variations can also cause perceived brightness of a LCD pixel to vary and cause loss of contrast for the viewer. In fact, the display performance illustrated in FIGS. 3 and 4 is different for each temperature.

It can therefore be understood that a graph of applied voltage versus relative luminance based on different temperatures at the LCD would normally involve the curve shifting increasingly in one direction upon increase in temperature. In the environment of an airplane cockpit, and because of the power dissipated by the back lighting of the liquid crystal material, temperature materially can effect brightness of pixels.

It is to be understood-that these "brightness" curves vary depending on a number of factors such as the type of liquid crystal, the physical structure of the liquid crystal cell or chamber, the type of electrodes utilized, as well as other factors. These graphs are exemplary, however, of the problems associated with horizontal and vertical off-axis viewing angles. It can therefore be understood why the problem is so difficult to solve. The exact viewing angle problems also change from LCD to LCD, because the curves change.

It should also be understood that there are situations where the pilot desires to manually vary the brightness of certain areas of the LCD, aside from varying the entire brightness which can be done by altering the back lighting of the display.

Obviously, the operating conditions and any requirements for specific location dimming or brightening also can vary for different LCDs. The challenge, therefore, which has not been solved prior to the present invention, is a way to accommodate in one system for all these variations that can affect how the pixels of an LCD are driven. For example, by looking at the graphs in FIGS. 3 and 4, it can be seen that the designer might consider a little over three volts as the optimal pixel driving voltage to turn the pixel "black" without concern for horizontal viewing angle when viewing FIG. 3. However, that same designer, in analyzing FIG. 4, may select 4.5 or 5 volts to drive pixel "black". The matter is then very complicated when considering the horizontal and vertical viewing angle curves of both FIGS. 3 and 4. The designer must, therefore, for each particular set of curves, select what are considered the best driving voltages to accommodate these different types of problems. Further complications arise when attempting to at the same time compensate for temperature, or to allow independent dimming or brightening of certain portions of the LCD.

D. Conventional Generation of Voltage for Driving Pixels

In essence, conventional pixel driving circuitry utilizes a standard gray level instruction set which then is correlated to a standardized voltage wave form from which a particular proportional gray level voltage is generated. In other words, in the example where a video signal is being replicated on the LCD, the graphics processor assigns an instructed gray level (brightness) for a particular pixel based on an interpretation of the video signal. Conventional circuitry generates, in correlated timing sequence, a linear ramp voltage wave form. The instructed gray level will cause a corresponding and proportional voltage from along that linear voltage ramp to be selected to actually drive the pixel to the desired gray level.

What this means is that regardless of viewing angle, temperature, or other factors, the circuitry will always select the same driving voltage corresponding to an instructed gray level. Therefore, if for example, it is known the LCD will be displayed at a certain angle to user's eye, there is no provision or ability to eliminate the off-axis viewing problem previously discussed unless major changes are made to the processing components. There is also no ability to easily compensate for temperature affecting the brightness. There is also no ability to easily allow the user to selectively brighten or dim a certain portion of the display.

E. Generation of Voltages According to the Invention

The present invention solves these problems. It does not do so by altering all the data instructions coming from the graphics processor. Rather, it allows customizable generation of the voltage wave form which actually drives the pixels. Put another way, when the data instructs a gray level for a particular pixel to a certain value, instead of always pulling a proportional voltage from a standardized linear ramp voltage, a wave form is substituted which can alter the value of voltage for the instructed gray level to compensate for the various problems that have been discussed. The designer knows what viewing angle problems exist, what temperature problems may exist, and the brightness range over which portion of the screen may be brightened or dimmed. The designer can therefore select and substitute driving voltages which will compensate or control individual or sets of pixels to the desired effect, or can allow it to change automatically by utilizing sensors or dynamically drawing information from the system.

Figures 14, 15:
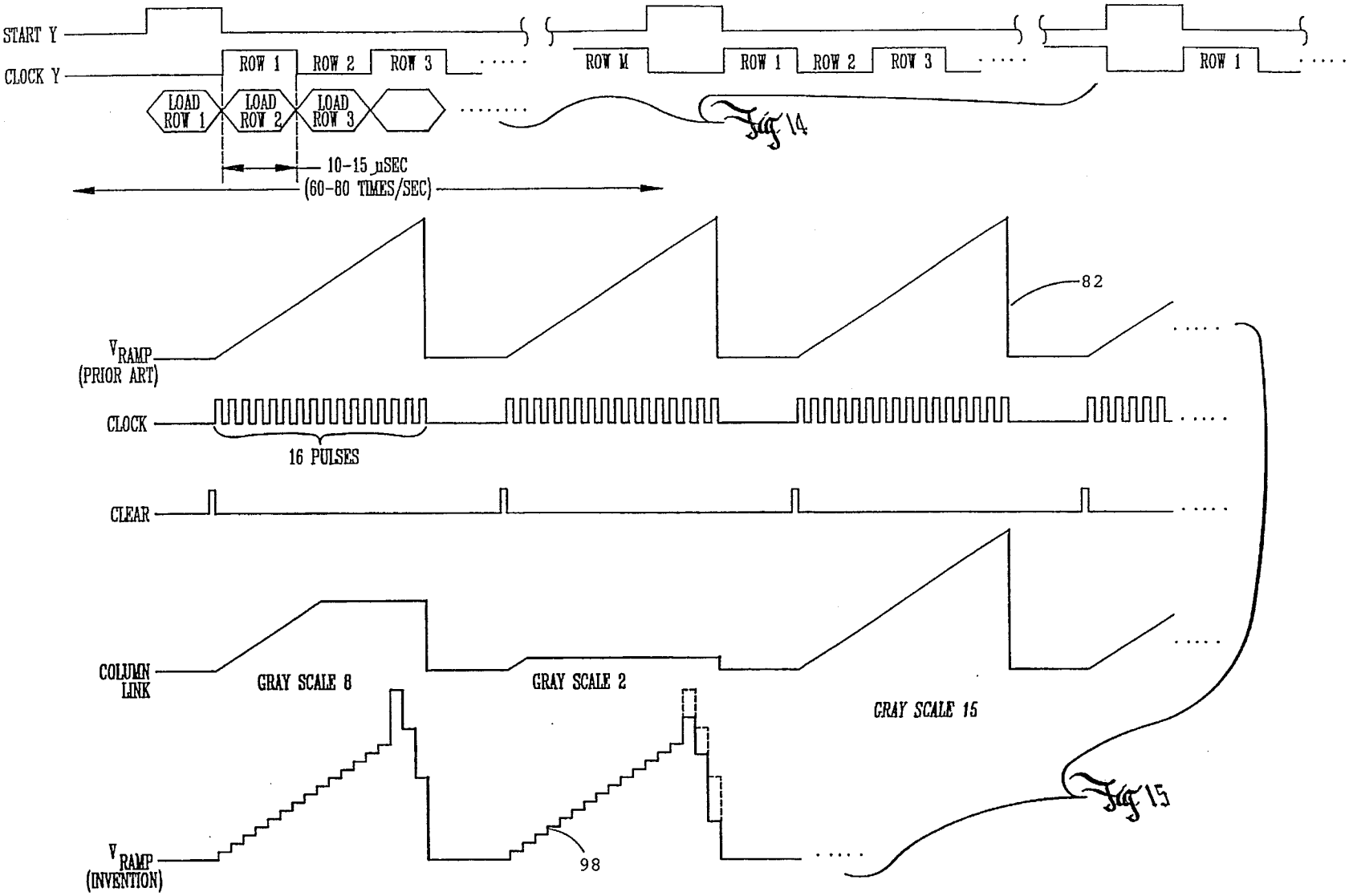
FIG. 14 is a graphical depiction of control signals for the drivers of FIG. 7.
FIG. 15 is a collection of signals utilized by the conventional circuitry of FIG. 5 and compares the prior art ramp drive voltage to an example of a ramp drive voltage according to the present invention.

The standard prior art conventional linear voltage ramp is shown at FIG. 15 (the top wave form). The second wave form illustrates clock pulses which break up the linear triangularly shaped prior art voltage ramp into 16 discrete values of increasing magnitude. The clock is restarted by the clear pulse (third wave form). The fourth wave form illustrates how different gray scales are selected from the prior art voltage ramp. A data signal which contains the gray scale instruction simply is correlated to correspond with a particular one of the 16 clock pulses. Therefore a gray scale 8 instruction would wait 8 clock pulses and then select that voltage level along the sloped ramp. A gray scale 2 would wait 2 clock pulses and then select that ramp voltage. A gray scale 15 would allow the entire ramp to be generated and select the peak voltage.

It can be seen that the prior art voltage ramp is repeating and non-changing. A graphics processor therefore deals with a fixed domain of 16 discrete gray scale levels. If the gray scale levels for particular pixels need to be changed to accommodate for some of the above described problems, this would have to be accomplished by preprogramming the graphics processor to change the data instructions to the LCD. This is difficult and unflexible.

The present invention therefore provides compensation or adjustment to gray scale levels going to the pixels by instead substituting the repeating, non-changing prior art voltage ramp with a dynamic, adjustable, customizable voltage ramp illustrated as the last wave form in FIG. 15 as an example. This is accomplished primarily in the circuitry which generates the voltage ramp, instead of having to significantly alter the display graphics components and processing. To understand how the customizable ramp voltage accomplishes the invention, requires an understanding of the functioning of a conventional graphics display circuitry associated with an LCD as discussed below. It is to be understood that this is one example only.

F. Conventional Graphics Display Circuitry

FIG. 5

Figure 5:
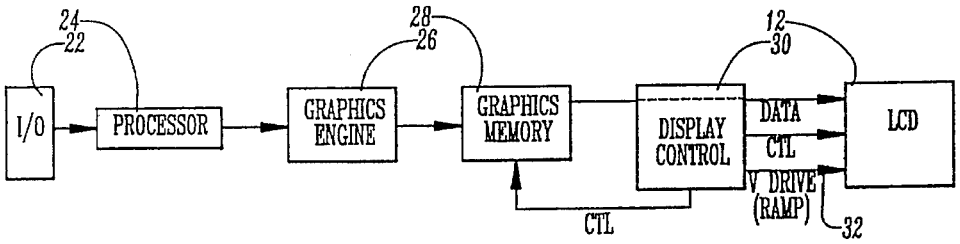
Fig 5 (PRIOR ART)
FIG. 5 is a block diagram of a conventional LCD and control circuitry.

FIG. 5 generally depicts in block form a conventional control circuit and LCD for an active matrix LCD 12. An input/output section introduces the source information to be displayed on LCD 12. A processor 24 and what will be called a graphics engine or processor 26 are electronic components which generate in digital format a graphic representation of what has been entered through the input/output 22. Graphics memory 28 is basically a pixel-by-pixel digital bit map of LCD 12. In other words, each memory address of graphic memory 28 would have loaded into it the gray level instruction for a corresponding pixel in the matrix of LCD 12.

As an analogy, graphic memory 28 basically contains frame by frame display instructions for LCD 12. It is noted that normally graphic memory 28 can utilize two RAMs of identical matrix size to the pixel's of LCD 12. One frame of display would be loaded into the first RAM which would then be sent out from graphic memory 28, while a succeeding frame is loaded into the second RAM. Other configurations are possible.

A display control circuit 30 controls and drives the pixels of LCD 12. In other words, circuit 30 converts the frame-by-frame digital bit-map information into correlated driving voltages for each pixel to replicate the frame-by-frame instructions into a dynamic image on the LCD. It selects the information from graphic memory 28 in a "line-by-line" manner and inputs that into drivers on LCD 12, while at the same time generating a voltage drive wave form 32 which is used by the drivers on display 12 to actually produce the applied voltage necessary to create the gray scale for each pixel.

As will be explained later, in this embodiment, the voltage drive wave is simply a correlated wave form which contains appropriate voltages for the range of gray scale levels desired for the particular LCD 12. It is therefore generally a linear ramp voltage (see FIG. 15 V (ramp) prior art) which is clocked with the loading of gray level information to the LCD 12 so that the drivers for LCD 12 can select the appropriate voltage from along the ramp and apply it across the corresponding pixel.

FIG. 6

Figure 6:
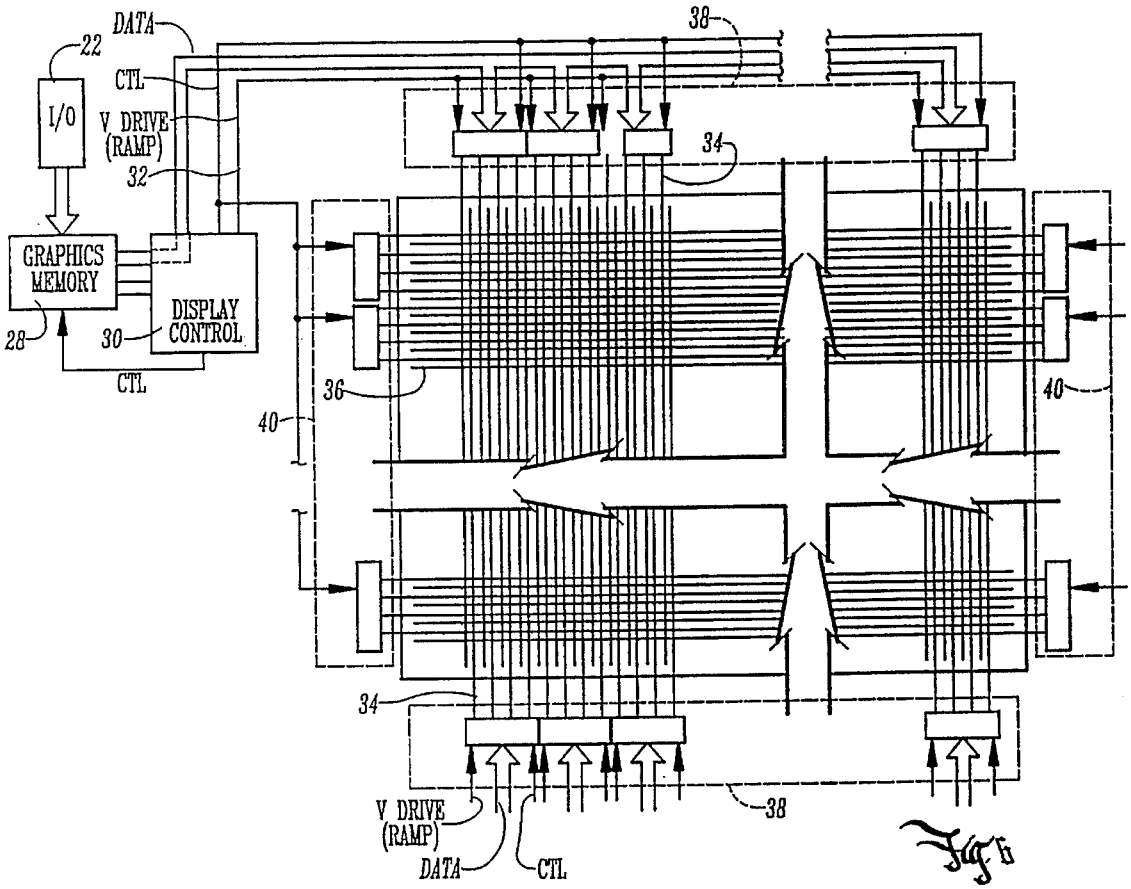
Fig 6 (PRIOR ART)
FIG. 6 is a diagrammatical view of the circuitry and LCD of FIG. 5 but showing in more detail the driving components and circuitry for the actual pixels of the LCD.

FIG. 6 illustrates with more specificity the structure of LCD 12 and its driving components. LCD 12 in this embodiment comprises 1,024 rows by 1,024 columns of pixels although larger and smaller arrays are possible and not precluded. For purposes of this description, only a portion of the entire matrix will be discussed. As previously discussed, each pixel is provided with voltage by concurrently driving a column electrode 34 with the appropriate row electrode 36. In FIG. 6, it can be seen that a number of column drivers 38 and row drivers 40 are utilized. Each driver 38 and 40 controls only a few corresponding column or row electrodes 34 and 36. One column driver might, for example, drive 128 column electrodes 34.

The display controller 30 does the following. It passes the bit map information of graphic memory 28 to the column drivers 38. It controls the row-by-row actuation of row drivers 40. It also generates the drive voltage ramp wave form 32. Everything is coordinated by a common clock so that matrix 12 is scanned in the sense that succeeding rows are parallely transferred through column drivers 38 and row drivers 40 are sequentially enabled so the screen is scanned from top to bottom for the contents of memory 28.

FIG. 7

Figure 7:
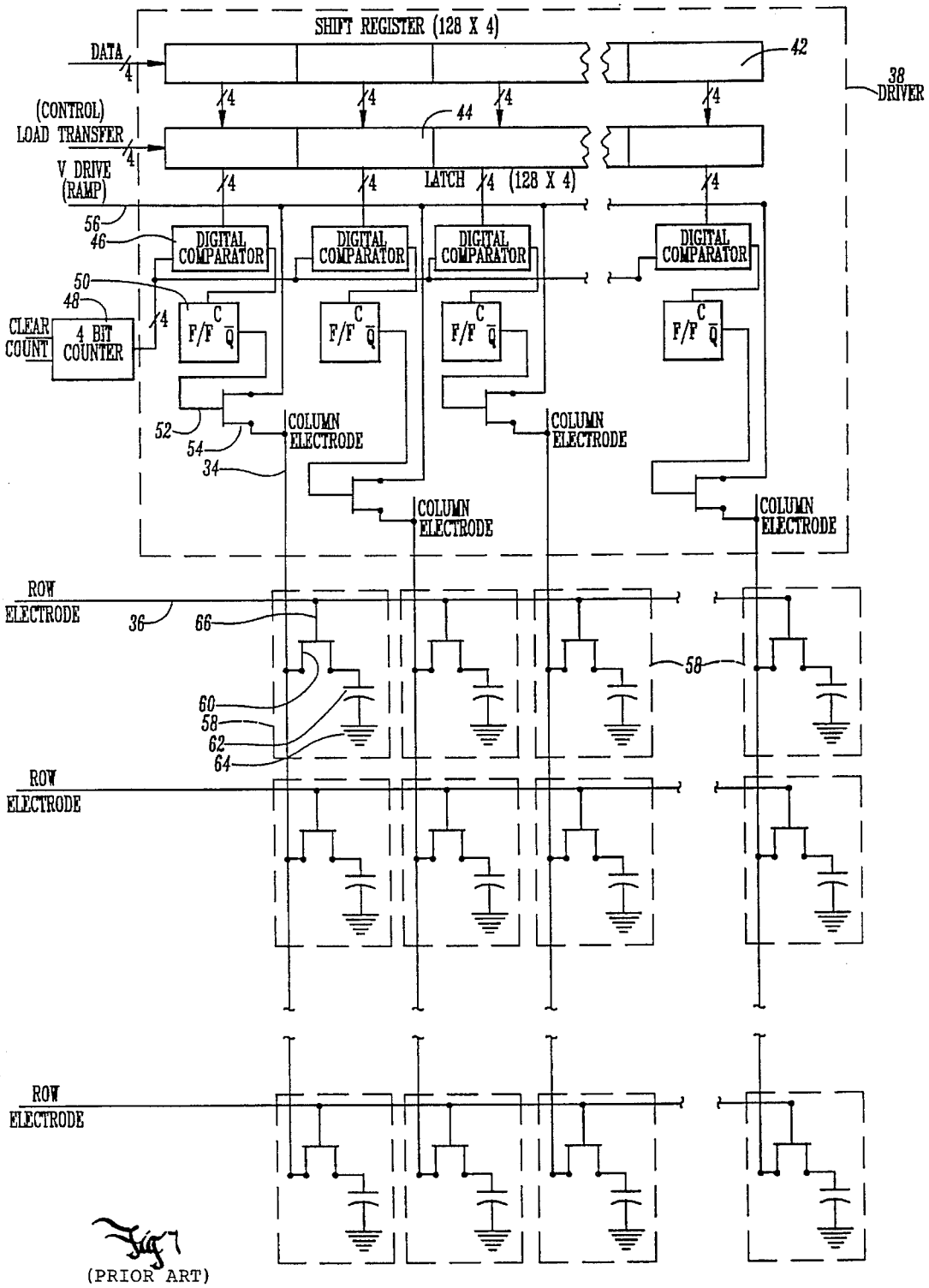
Fig 7 (PRIOR ART)
FIG. 7 is diagrammatic and partial schematic view illustrating more specifically the driving elements for the pixels of the LCD.

FIG. 7 then shows in more detail how column drivers 38 convert the information from memory 28 into actual applied voltage to each pixel. In FIG. 7, a column driver 38 is shown in dashed lines. In simplistic form it contains a shift register 42 (128×4), having four bits of data storage for each column of electrodes 34. Data from memory 28 corresponding to a row is loaded into shift register 42 serially. Upon a clocked load/transfer signal, the entire contents of shift register 42 is sent to latch 44, which has a corresponding number of four bit memory locations (128×4) to shift register 42.

FIG. 7 shows that the contents of latch 44 is applied in a parallel fashion, 4 bits to each digital comparator 46. The four bit word corresponds to a instructed gray level which has been previously determined for the particular pixel according to the bit map contained in memory 28. In other words, the data loaded into shift register 42 and then sent through latch 44 to comparator 46 is the digital instruction as to which gray level is desired for the corresponding pixel.

The four bit instruction to comparator 46 is compared to the output of four bit counter 48. Counter 48 continuously increments between digital 0 and 15. Digital comparator 46 is connected to flip-flop 50, whose output is connected to the gate terminal 52 of FET transistor 54. Transistor 54 is normally conducting. When the four bit word from latch 44 is introduced to comparator 46, flip-flop 50 therefore does not apply any gate voltage to transistor 54 until a match is reached in comparator 46 with the input from counter 48. In other words, voltage from V (ramp) is allowed to pass through transistor 54 until a match in comparator 46 is made and flip-flop 50 shuts off the conducting of transistor 54 by enabling gate terminal 52.

FIG. 7 also depicts how voltage is applied to each pixel. A dashed line 58 indicates the general location of a pixel 58. Column electrode 34 and row electrode 36 intersect, but are not connected at pixel 58. Column electrode 34 is connected to one side of TFT transistor 60. The other side of transistor 60 is connected to capacitor 62 which in turn is connected to ground 64.

The row electrode 36 is connected to the gate terminal 66 of transistor 60. Therefore, when a V (ramp) signal is introduced to line 56, in coordination with the loading of the four bit gray scale level word to digital comparator 46, the V (ramp) signal passes through transistor 54 and transistor 60 (enhancement mode) and charges capacitor 62 until comparator 46 instructs flip-flop 50 to bias transistor 54 to a non-conducting state. Capacitor 62 will therefore be charged with a voltage selected by the four bit word that was loaded to digital comparator 46 from latch 44. That voltage is correlated to the gray level desired for that pixel 58 by its predetermined relationship with the desired gray scale. When the row electrode 36 is returned to a low state after charging of the capacitor 62, it turns transistor 60 to a non-conducting state, and essentially locks in the voltage to capacitor 62. The mere presence of the voltage potential at pixel 58 causes the liquid crystal material to align in correspondence with the voltage level to create the desired transmissivity (or gray scale or brightness).

It is therefore understood that the data in the shift register 42 is for one row of pixels 58 at a time. That data therefore usually changes for each row. Just capacitors 62 for one row of pixels 58 therefore will charge with the ramp voltage for a particular time. However, each capacitor is charged according to the instructed gray scale in the particular four bit data word for that pixel. That voltage potential will be locked in and cause the particular pixel 58 to operate at the instructed gray scale.

It is therefore important to understand that in the prior art embodiments, a standard V (ramp) is utilized for all rows and for all occasions (see FIG. 15—prior art V ramp). V(ramp) is a repeating non-changing saw-toothed shaped signal, with each pulse of the signal beginning at a minimum voltage set to insure that all pixels are fully transmissive (fully bright), and linearly increasing to a maximum voltage to insure all pixels are minimally transmissive (fully dim or black) (at least from a straight on-axis view). The ramp is then divided into 16 portions which are individually selectable as gray scale values. The four bit counter 48 therefore essentially stops the connection of the linearly increasing ramp pulse to pixel capacitor 62 when it reaches the desired gray scale voltage value along that ramp (see FIG. 15, "column" signal), acting as a track and hold circuit.

FIG. 8

Figure 8:
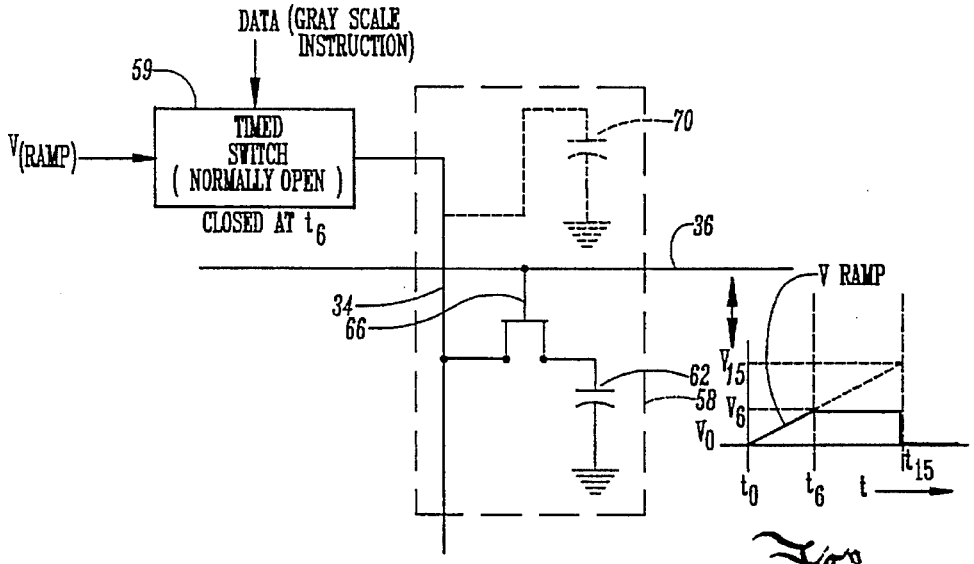
Fig 8 (PRIOR ART)
FIG. 8 is an isolated schematic depiction of circuitry utilized to provide a voltage potential to a pixel to create gray scale at the pixel.

FIG. 8 shows schematically and in isolation a pixel 58. Comparator 46, counter 48, flip-flop 50, and transistor 54 (see FIG. 7) really act like a timed switch 59 which allows a portion or all of the V (ramp) pulse to charge capacitor 62. It is to be understood that parasitic capacitance represented at 70 also can exist with regard to pixel. This is not germane to the invention, however. In FIG. 8, for example, if the gray scale instruction calls for gray scale level 6, switch 59 would allow V (ramp) to charge capacitor 62 until t6, when V (ramp) would be cut off at V6, which corresponds to gray scale 6. Other pixels along the row would be charged to a level from V (ramp) controlled by a switch 59, in turn controlled by the independent gray scale instruction for that pixel.

The basic functioning of the control circuitry and active matrix LCD according to this preferred embodiment of the invention has now been described. It is important to the understanding of the invention to understand this operation. It has also been shown that the actual brightness of the pixel is controlled by the voltage applied across it. This is controlled by generation of a repeating non-changeable linear V (ramp) from which can be pulled one of sixteen discrete linearly varying voltages. The digital four bit gray scale instruction tells the circuitry which of the sixteen discrete linear voltage levels should be actually applied across the pixel.

This type of arrangement is modified by the invention to allow flexible efficient adjustment or compensation of gray scale or brightness of individual pixels to correct or reduce problems associated with viewing angle, temperature, selected brightness or dimming instructions for portions of the display, etc. How this is accomplished will now be discussed.

B. Circuitry According to the Preferred Embodiment of the Invention

FIG. 9

Figure 9:
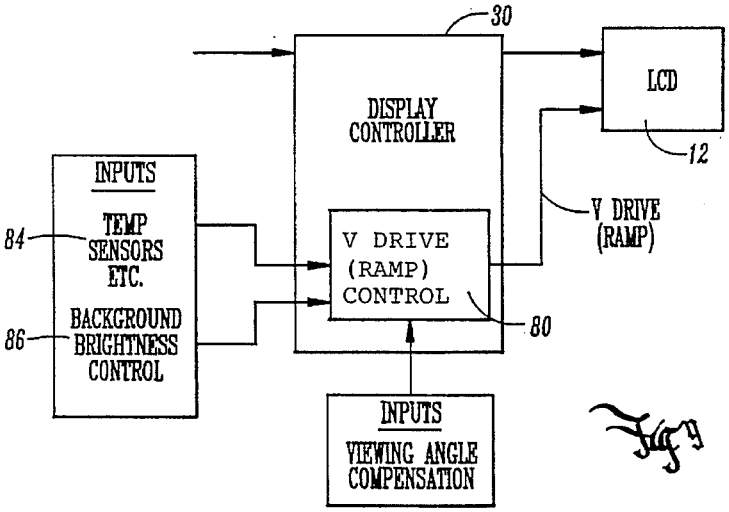
FIG. 9 is a simplified block diagram showing the position of the present invention as inserted in the conventional circuitry of FIG. 5.

The present invention adds a portion of circuitry 80 to the conventional circuitry of FIG. 5. As shown in block diagram form in FIG. 97 circuitry 80 is added to the display graphics control 30 to generate a customized V (ramp) signal 98 (see FIG. 15 for one example, and FIGS. 16 and 17 for additional examples). It is further shown in FIG. 9 that circuitry 80 can include inputs from such things as temperature sensors 84, and brightness control 86. It is also to be understood that circuitry 80 can include pre-configured components or information derived from such things as knowledge of the viewing angle of the particular LCD, or other parameters which can affect the visual performance of the display.

The invention therefore essentially produces a substitute V (ramp) signal 98, which can vary in time according to constant or time varying inputs.

Figure 16:
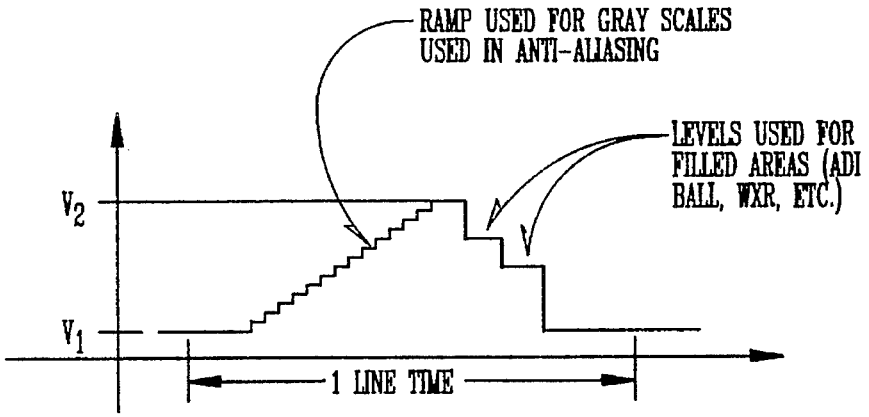
FIG. 16 depicts an alternative isolated ramp drive voltage signal according to the present invention.
Figure 17:
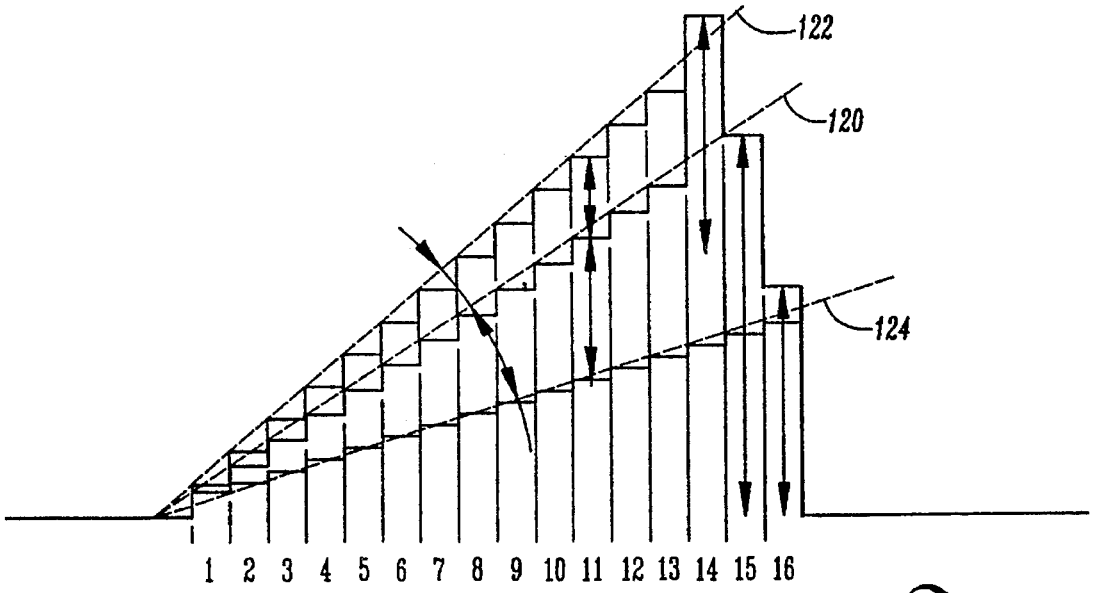
FIG. 17 is a still further example of an alternative ramp drive voltage signal according to the present invention.

It is to be understood that circuitry 80 can take on many forms and configurations. Its produced result, however, is always a dynamic, customizable V (ramp) 98. Essentially, circuitry 80 generates a V (ramp) 98 of virtually any shape or configuration desired. It can basically simulate the linear prior art V (ramp) 82, if all that is desired is a linearly increasing wave form having generally equivalent magnitudes for equivalent times to that of the prior art V (ramp) 82. However, circuitry 80 can also generate a V (ramp) 98 which can look drastically different than a linear ramp 82. As shown in FIGS. 15, 16 and 17, it can consist of a plurality of discrete steps. A portion of the steps can simulate a linear ramp. Others can be selected at non-linear widely varying values.

As will be discussed in more detail later, these customizable V (ramps) 98 can be utilized to compensate or adjust for viewing angle problems, temperature compensation, or electable dimming or brightening of portions of the display.

Before the preferred embodiment will be described, a simple example of possible circuitry for circuit 80 will be discussed to help understand how the V (ramp) 98 according to the present invention might be generated. For certain applications where the range in the gray scale values from those represented in the prior art V (ramp) 82 can be easily derived and will not change quickly, the following setup could be used. Sixteen different variable voltage generating components could be connected to a high speed analog multiplexer switch. If the V (ramp) 98 is desired to simulate a linear ramp, the voltage generating components could be interconnected in some sort of a ladder network so that sixteen discrete and linearly increasing voltages would be provided to the high speed analog switch. The multiplexor switch would then in sequence take each voltage level and produce a stepped linearly increasing voltage wave form with the sixteen discrete steps. Once the wave form is produced, the timing circuitry would then reset the components and build an identical wave form. If the voltages need to be adjusted, the voltage producing components would be adjusted to produce different magnitudes or a different slope of the wave form.

The magnitude and slope of the voltages of such a wave form could be determined by analyzing the particular adjustment or compensation needs for the particular LCD. For example, temperature sensors could automatically issue instructions to the voltage generating components to increase their magnitude upon the sensing of increasing temperature at the LCD. Magnitudes could also be manually adjusted by appropriate inputs. Still further, if it is known that the LCD will be at a certain angular orientation to the viewer, the magnitude and slope of the ramp 98 can be pre-adjusted.

It can therefore be seen that the basic concepts of the invention are to compensate or adjust for these problems, not by altering substantially the display controller, the graphics memory, graphics engine or processor for the system, but rather by altering the voltage signal utilized to convert the digital wave gray scale data for each pixel into an analog voltage.

A more detailed discussion with respect to the preferred embodiment of the invention will now be described.

C. General Preferred Embodiment

FIG. 10

Figure 10:
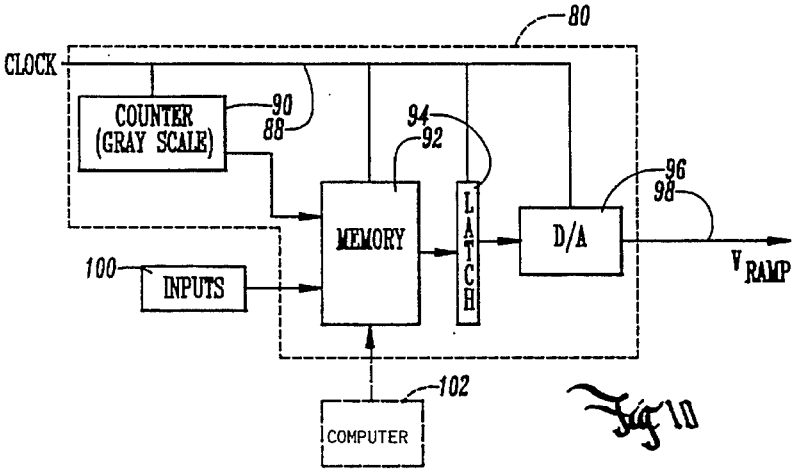
FIG. 10 is a general block diagram of the circuitry of a preferred embodiment of the present invention.

FIG. 10 depicts the overall structure of the preferred embodiment for circuitry 80. A clock signal 88 from the display control 30 is utilized by a counter 90, memory 92, latch 94, and a digital to analog (d/a) converter 96. The result of operation of these components produces V (ramp) 98 which is substituted for the conventional V (ramp) 32 previously discussed.

Memory 92 can have a variety of inputs 100. Inputs 100 can consist of transducers, switches, signals from the display control 30, etc. It can also include a connection to a computer 102.

Essentially, the inputs 100 allow parameters related to operation temperature, background dimming or brightness, or viewing angle for the LCD to be input to the system and controlled or compensated by the customized V (ramp) 98 98 created by circuitry 80.

Just how this is accomplished will be described with the following examples. If the temperature sensor were connected to input 100, and included an A to D converter, continuous temperature information could be applied to memory 92. The information regarding temperature could be utilized to alter the ongoing instructions from memory 92 sent through clocked latch 94 to D/A converter 96 to in turn alter the V (ramp) generated by converter 96.

One way to accomplish this would be to assign the digital values corresponding to the sensed temperature to addresses in memory 92. Those addresses in turn would cause different memory locations to be accessed and output to latch 94 according to temperature. Those different addresses would contain different instructions as to how the D/A converter would generate V (ramp) 98. For example, if the sensed temperature was such that it would diminish the contrast of the LCD display 12, memory 92 would send through latch 94 instructions to alter V (ramp) 98 to increase the voltage magnitude of the entire V (ramp) 98 so that no matter what gray scale level was instructed, it would be increased thereby darkening all black pixels to compensate for the temperature problem. When the temperature returned to a better range, different instructing data from memory 92 would be issued to latch 94 and V (ramp) 98 would return to normal.

As another example, if it is known that display 12 will be in a certain position in the aircraft cockpit relative to the pilot, it is possible to calculate the viewing angle for the pilot both horizontally and vertically. A set of luminance versus voltage curves similar to FIGS. 3 and 4 could then be empirically derived for that display. Digital instructions could be loaded (by computer 102) into memory 92 containing data which can create a V (ramp) 98 to compensate for this problem. Then instead of utilizing purely linear non-changing V (ramp) 82, circuitry 80 would generate a customized, dynamic V (ramp) 98 which would raise or lower the applied voltage for a selected gray scale level based on the compensation derived from the luminance versus voltage plots and based on the position currently being scanned on the LCD. In other words, if the viewing angle for a portion of the display was such that if a gray scale level 8 normally required 2.5 volts and the display control 30 instructed gray scale level 8 to the LCD, the V (ramp) generated by circuitry 80 would automatically present an increased voltage at the corresponding position of the ramp 98 if more voltage would produce the same or similar level of brightness even for an off-axis viewing angle.

As a still further example, the pilot could have a manual control 86 which could be operated to dim a particular portion of the LCD. The manual control would have an A to D converter to introduce into memory 92 information as to the brightness of the manually changeable position of the manual control. That information would be used to address a portion of memory 92 which would in turn contain data which would be output to latch 94 to instruct the D to A converter 96 to increase or decrease the voltage of V (ramp) 98 for pixels with dimmable images, as determined by the controls of graphics memory 28. Thus, if dimming is desired, the magnitude of the V (ramp) 98 would be increased so that when the display control 30 called for certain gray level at the area requested to be dimmed, it would in fact receive a brighter gray level than requested simply by virtue of the customized V (ramp) 98 generated by circuitry 80.

FIG. 10 therefore diagrammatically illustrates the basic structure of the preferred embodiment of the invention. Counter 90 is controlled by the clock signal which is correlated to the clock timing of the operation of the display controller and the scanning of rows of the LCD. In the examples discussed in this detailed description, a V (ramp) 82 of sixteen discrete values is utilized (although it is to be understood that this could be increased or decreased according to desire). Counter 90 therefore provides the sixteen discrete values that are available to make up one pulse of V (ramp) 82. It is to be remembered that each pulse of V (ramp) 82 is coordinated so that it is available to one row of scanning of the LCD at a time. However, the V (ramp) 98 generated by circuitry 80 can change any or all of the sixteen discrete portions of the V (ramp) 82 pulse from pulse to pulse.

Inputs 100 in FIG. 10 represent any number of different time varying or non-time varying instructions or information which can be utilized to adjust or compensate the V (ramp) 82. Previous examples have been temperature sensors, switches or potentiometers to select between various levels of desired brightness for various portions of the display, and information regarding the positioning or viewing angles of the LCD in the airplane cockpit. Others are possible. An additional input is represented by personal computer 102, which could be utilized to load in data regarding viewing angle or voltage versus luminance curves, or other information relevant to adjusting the V (ramp) 82 to accomplish adjustment or compensation for the LCD.

It is to be understood that computer 102 can either load information into memory 92 before it is installed into circuitry 80, or it can be used to change the information in memory 92 from time to time, and then be removed; or it can be an input from a processor which is a part of the LCD control circuitry.

The input 100 can also consist of information from the display processing circuitry. For example, information as to which row or set of rows is currently being scanned in the LCD can be input. This would allow information to be stored in memory 92 which is location specific for the LCD. It can also serve to point to the appropriate locations in memory 92 and output the appropriate data to latch 94 from which the D/A converter 96 can build the individually customizable V (ramp) 98 pulses.

Circuit 80 of FIG. 10 therefore basically utilizes memory 92 as an information bank. By empirical testing and subjective decisions regarding what type of adjustments should be made to the V (ramp) 82, digital values can be stored in memory 92 for different choices. The inputs to memory 92 consisting of counter 90 and inputs 100 are basically combined into a single input byte and on each clock pulse are input and define an address location in memory 92. Thereafter, the data stored in the memory location is output to latch 94. That data is the predetermined, pre-loaded data which instructs the D/A converter 96 the magnitude of voltage it should generate for that particular clock pulse.

It should be understood that this combination is a way to bring the knowledge derived from the voltage versus luminance curves, the data regarding how temperature affects performance of the LCD, and exactly where in the LCD certain portions can be dimmed or brightened, into the circuitry in a manageable format. It is a simple way to store all types of different variations for building the V (ramp) 98 and then allows the inputs to the memory to tell the circuit which of those variations should be utilized.

In FIG. 10, counter 90 is utilized to repeatedly increment from 1 to 16 the address byte formed by the combined counter 90 input and inputs 100 input to memory 92. More specific examples of configurations for circuitry 80 will follow.

D. Specific Examples

FIG. 11

Figure 11:
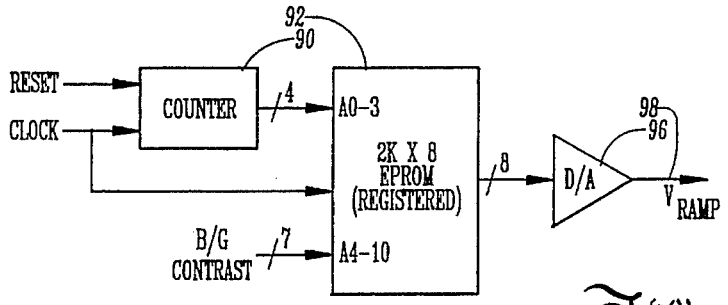
FIG. 11 is a more specific block diagram of an embodiment of FIG. 10.

FIG. 11 sets forth in block form more a specific version for the structure of circuitry 80. Counter 90 would issue a four bit ascending count which would be reset every 16 clock pulses. Memory 92, in this instance a 2K by 8 EPROM, would output an eight bit word to D to A converter 96 which would instruct converter 96 as to what shape the ramp should attain for that particular time.

In FIG. 11, the B/G (back ground) contrast input shown to memory 92 was a seven bit input from a background contrast control. The sixteen counter 90 values are utilized as control codes. Some of the control codes may be used to represent background levels whose overall brightness level is proportional to the background contrast input. For example, if 12 codes are reserved for foreground brightness and four for background brightness, when counter 90 outputs anything between zero and 11 inclusive, memory 92 output to converter 96 will be at some predetermined value corresponding to the gray scale levels 0 to 11. For codes 12–15, the outputs will be proportional to background contrast. Other variations are possible.

The four bit output from counter 90 and the seven bit output from B/G contrast would form the inputs into memory 92. Those inputs would form an eleven bit word which comprises an address location for memory 92. As can easily be understood, counter 90 would increment the address by one each time until the sixteenth count and then reset. The seven bits form B/G contrast. There would therefore be 120 different possible values for background contrast. By using this format, memory 92 can be pre-loaded with all the different variations for background contrast according to designers preferences. On each counter increment, the presently selected background contrast value desired would be accessed in memory 92 and the data at that address location (an 8 bit value having 256 possible variations) would be output to D/A converter 96 and instruct it to the particular level to create a magnitude of voltage for the V (ramp) 98 for that particular moment.

FIG. 11 therefore illustrates how circuit 80 would work with counter 90 and one input (B/G contrast) as inputs. More complex arrangements are possible.

FIG. 12

Figure 12:
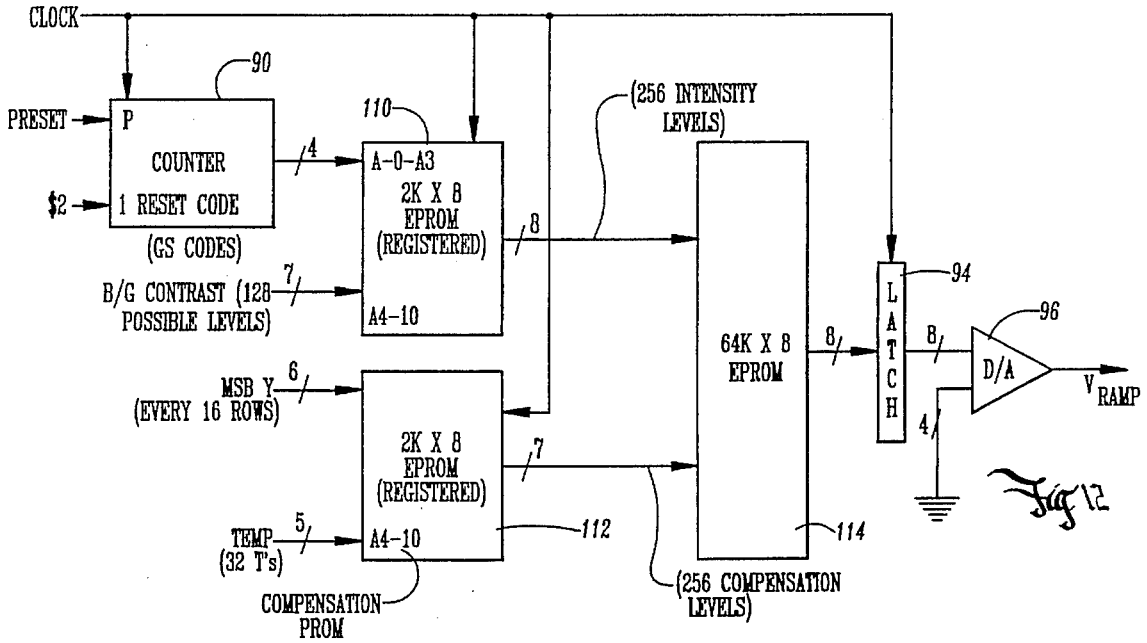
FIG. 12 is a diagram of an alternative embodiment of FIG. 10.

FIG. 12 depicts an alternative configuration for circuitry 80. Instead of a single memory 92, EPROMS 110, 112, 114 are utilized. EPROM 110 is a 2K by 8 registered EPROM. It receives a four bit gray scale code from counter 90. In this example it also receives the seven bit background contrast code.

EPROM 112 is a 2K by 8 registered EPROM and can receive a six bit Y-ROW count representing the most significant bits of the number of the current selected display row. It can also receive an five bit temperature input. These are combined into an eleven bit address byte.

In this embodiment EPROM 110 will be called the "intensity prom" whereas EPROM 112 will be called the "compensation prom".

Intensity prom 110 converts sequential gray scale codes and background contrast levels into an eight bit intensity value. Compensation prom 112 computes the total compensation as a function of temperature and the Y address of the scan of the LCD display 12. Those two eight bit output bytes are input into EPROM 114 as a 16 bit address byte (which is a 64K by 8 EPROM associated with eight bit latch 94). EPROM 114 combines the intensity and compensation controls along with any predetermined and pre-entered luminance versus voltage characteristics into an eight bit voltage command. The latch 94 applies the eight bit voltage command to D/A converter 96 which changes the command into the correct voltage ramp 98 signal.

Operation of the embodiment of FIG. 12 can be understood by characterizing the use of EPROMs 110, 112, and 114, as an information management system. Data for the address locations in those PROMs is pre-loaded based on empirical derivations of the designer. In other words, the designer knows ahead of time the numerous different possibilities that are desired or needed for the system. For example, normally some type of gray scale is required. Therefore, the designer can utilize the intensity PROM 110 to load in what would be called nominal voltage values for different levels of gray scale. What this means is that a set of gray scale values (normally at least 8) that will be used as standards and which will not change will be utilized by the system. If, for example, eleven gray scale values are going to be utilized, data correlated to those eleven different values will be repeated in blocks of memory in intensity PROM 110. As shown in FIG. 12, the background contrast has 128 possible levels and therefore the different gray scale combinations and the different background contrast combinations all can be input into PROM 110. The combined 7 and 4 bit words are then utilized to form an address input to PROM 110. Depending on the set contrast level and the current counter number, a particular address in PROM 110 will be accessed. The 8 bit data in that location will then be sent to PROM 114 and will comprise one of 256 intensity levels.

At the same time, in FIG. 12, the compensation PROM 112 has as inputs a 6 bit word corresponding to the most significant bits of the current row of the LCD being scanned. Additionally, a 5 bit word from the temperature sensors is input. These combined inputs again form an address for PROM 112. The data for each of the memory locations in PROM 112 has previously been inserted by empirical knowledge derived from effect of temperature on lumminance for various voltages. The most significant bit for the Y-row count is obtained from the display processor. The output from PROM 112 is an 8 bit compensation level. This 8 bit word from the compensation PROM and the 8 bit word from the intensity PROM are combined to form the address for the large E PROM 114. E PROM 114 in turn contains data at its address locations corresponding to the many different possible variations of intensity levels and compensation levels. It outputs an 8 bit word (256 possible variations) to latch 94 which in turn is sent to the D/A converter 96 to actually generate an analog voltage level of the magnitude desired for that instant in the ramp 98 (one of 16 per ramp pulse).

Therefore, to allow the voltage ramp 98 of 16 discrete values to be built independently for each pulse, requires that the enormous amount of possible variations for both nominal values and compensation values be quickly available. By having all these possible variations in a pre-loaded fashion into these memories, they can be managed as herein described. The input to E PROMS 110 and 112 are addresses which find the appropriate address location in those memories. At that location is an 8 bit piece of data. Those pieces of data are then combined to form an address location for PROM 114. At that address location is a piece of data which instructs the D/A converter exactly what magnitude of voltage to generate.

The circuitry is tied into the clock for the system so that it builds a V (ramp) 98 pulse for each time period required for each row of scanning of the LCD. It also builds 16 discrete levels of voltage magnitudes so that it can operate according to the structure of the column drivers explained in association with FIGS. 6–8.

FIG. 13

Figure 13:
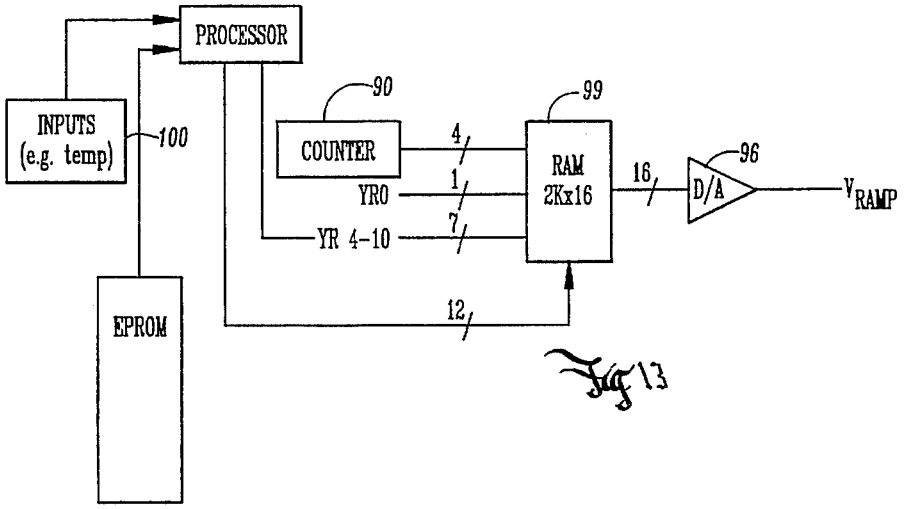
FIG. 13 is a diagram of another alternative embodiment of FIG. 10.

FIG. 13 schematically depicts an alternative embodiment for circuit 80. Instead of utilizing E PROMS such as shown in FIGS. 11 and 12, a RAM 99 can be utilized. It would work similarly to that described above in that it would manage the empirically derived information and provide it to D/A converter 96. It would not require as much memory because a processor could be utilized to continually update any changes in data such as temperature. The processor could also then access an E PROM to pull out non-time varying information. The RAM could be refreshed every selected time period and would work well for data which does not change very quickly. Because temperature of the LCD would change over minutes instead of microseconds, this would be possible. Inputs such as shown in FIG. 13 regarding Y-Row count (most or least significant bits of the current Y-Row count) change at a manageable rate. They would be utilized to address locations in the RAM which has been filled by information from the processor. In turn, that information can then be output to the D/A converter and generate the ramp wave form 98 as above described.

FIG. 14

FIG. 14 depicts the signals which control operation of drivers 38 and 40 of FIGS. 6 and 7. Each display scan (row-by-row) is initiated by the start Y pulses. Clock Y pulses start at every "start Y" pulse and provide equal-in-time pulses for dumping, in parallel, the information for each row sequentially into individual comparators. At each transition of clock Y, the current selected row line 36 is disabled and the next row line is enabled.

FIG. 14 also shows how the contents of each row are loaded into the latches during the interval in between clock Y transitions.

FIG. 15

FIG. 15 illustrates conventional driving ramp pulses 82 for a conventional LCD circuit. Prior art V (ramp) 82 is the saw tooth linear ramp. The clock pulses basically divide each linear ramp 82 into 16 discreet components. The clear pulse restarts the V (ramp) 82 and the clock.

As an example, if an eight level gray scale is requested, circuitry would allow the V (ramp) 82 applied to column line 34 to increase until the eighth clock pulse. At that point the V (ramp) 82 would be cut off from the charging capacitor and the appropriate gray level voltage would be locked into the charging capacitor. The clear pulse would clear system and allow a new linear ramp 82 and gray value for the particular pixel to be received. Such an example is shown in FIG. 15 (first wave form). It may be that the next row pixel requires a much lower gray level and therefore the ramp 82 would be cut off very early on in the pulse (4th wave form). FIG. 15 also shows an example of the modified V (ramp) 98 according to the present invention. Instead of the saw tooth linear ramp 82 of FIG. 15, a stepped ramp 98 can be utilized. The ramp 98 can be customized to any required magnitude. In other words, it could closely simulate the V (ramp) 82 of FIG. 15, or each of its steps could be raised or lowered to raise or lower the applied voltage called for each gray scale level. Moreover, some of the sixteen discrete components of the V (ramp) 98 could be reserved for customized and continuously varying voltage levels. In FIG. 15, for example, the last three portions of the V (ramp) 98, according to the invention, have widely divergent values that could change, for example, from pulse to pulse drastically.

For example, in the second pulse of V (ramp) 98 (invention) of FIG. 15, the 14th peak is noticeably less than the 14th peak of the first pulse. This could accomplish the following result. For the row of pixels powered by first pulse of V (ramp) 98 (invention), some may require the very high voltage of 14th component of that pulse. The next row, however, may desire a substantially lower voltage for that selected gray level. The second pulse may therefore be at a much lower level from the first (see dashed lines in second pulse).

FIG. 16

FIG. 16 illustrates one pulse for V-ramp 98 generated according to the present invention. It shows as V1 and V2 the respective voltage limits for the pulse, which in turn represents voltage for highest transmissivity and the voltage for lowest transmissivity. Fourteen linearly ascending steps are utilized for gray scales. The last two steps are utilized for selective dimming of areas on the LCD. In other words, the display processor would be configured to instruct gray scales 14 or 15 to be reserved for desired dimming steps for selected pixels. It is to be understood that each of these types of pulses shown in FIG. 16 could be varied from pulse to pulse based on inputs to the circuitry for generating V-ramp 98.

FIG. 17

FIG. 17 depicts examples of how the pulse could change. Generally, a linerally ascending gray scale of at least eight discrete levels is desired (here 14 steps are shown). Reference numeral 120 in FIG. 17 shows how one pulse of the V-ramp 98 may look. Positions 1 through 13 are basically a linear ramp for gray scale. Positions 14 through 16 can be reserved for special functions. Position 14, may for example, used for producing a very, very dark pixel.

Curves 122 and 124, however, show that for different pulses of the V-ramp 98, the slope of the portion of the V-ramp 98 between timing segments 1 through 13 can be changed. This illustrates how the entire range of gray scales can be increased or decreased for temperature compensation, viewing angle compensation for certain parts of the screen or the whole screen, etc. Note also that it is generally the slope of the gray scale ramp that changes rather than the entire scale shifting upwardly or downwardly. This is based on the fact that the curves of FIG. 3 and 4 tend to require more compensation at the right hand or higher voltage side than at the lower voltage side. This allows the system of the invention to weight or automatically compensate more for those driving voltages.

FIG. 17 also shows by arrows how individual time segments of the ramp pulse can be adjusted in magnitude from pulse to pulse. Therefore, for example, if spatial modulation is utilized as will be described in more detail below, portion 14 during one pulse could be at the upper level to drive that pixel at a high voltage. At the next pulse it can be dropped to a low level. Part of the flexibility of the invention is that individual portions of the 16 components of each pulse can be individually adjustable in magnitude to a very fine degree (in the preferred embodiment 256 discreet levels), instead of having only sixteen choices.

E. Spatial Modulation

The above description sets forth how a driving voltage ramp 98 can be created which can be varied for a number of different parameters. This same structure and method can be applied to solving the problem of drastic brightness variations or even color reversal caused by change in viewing angle from substantially on-axis to off-axis. The same structure and methods described above can also be utilized to solve a variety of LCD viewing problems and deficiencies according to a concept which will be called spatial modulation.

By referring to FIG. 4, it can be seen that relative luminance of a pixel can be substantially different depending on whether the LCD is viewed head on (on-axis) or from a vertical or horizontal angle oblique to a perpendicular from the plane of the LCD and off-axis. As previously discussed, this in turn can present a significant problem to the perceived composite brightness of locations on the LCD, or can even cause color degradation or reversal on the display. FIG. 4 illustrates this problem. At two volts, the luminance of a particular pixel when viewed on-axis would be quite high (almost 80% relative luminance when viewed on-axis). The perceived luminance of that same pixel would degrade to under 20% for a 40° vertical viewing angle. This means that if a collection of pixels in a portion of a LCD were intended to be bright in comparison to the background, they would be so for on-axis viewing but would turn substantially dimmer when viewed at a vertical 40°. In an interesting twist, at four volts, the same pixel, though intended to have only approximately 3% relative luminance (essentially black) would be so when viewed on-axis. However, when viewed at 40° vertical viewing angle off-axis, it would have over 10% luminance (a shade of gray).

As previously described, this means that at substantial off-axis viewing angles, pixels in a portion of the display driven to an intended luminance can have a perceived luminance drastically different than intended. Still further, as previously discussed, if the LCD has colored filters over the pixels to produce color reproductions, degradation of the intended colors, or even color reversal can occur. Color reversal happens at large viewing angles when the intensity of pixels which are intended to be driven towards black to allow other colored pixels to be predominant, are actually perceived as having a substantial amount of luminance (are brighter) and in fact may overcome the luminance of those intended to create the color. This reversal basically occurs because the dimmer pixels actually become the brighter pixels.

The present invention therefore compensates for these types of problems as follows. The viewing angle for a LCD is derived. Luminance to voltage curves similar to those of FIGS. 3 and 4 are then empirically derived. By analyzing these curves, the brightness degradation and reversal problems can be identified. One approach to solving this problem is to then simply generate a voltage ramp 98 which compensates the applied voltage to bring it back into a range that would correct the problems caused by viewing angle. This is not always possible however. The present invention therefore takes the following approach as an alternative to solving this problem.

The following example illustrates the solution. If the graph of FIG. 4 is taken as an example of luminance versus applied voltage plot for the LCD, it is to be understood that with a normally white background, each pixel will have maximum luminance or appear brightest at one volt. Different gray scale levels corresponding with diminishing brightness or luminance can then be established between one volt and around four volts. However, as can be seen, for different viewing angles, pixels driven at four volts may or may not appear black.

Arbitrarily and for example only, the following gray scale might be established.

| APPLIED VOLTS | GRAY SCALE |
|---|---|
| 1.2 | 15 White |
| 1.4 | 14 |
| 1.6 | 13 |
| 1.8 | 12 |
| 2.0 | 11 |
| 2.2 | 10 |
| 2.4 | 9 |
| 2.6 | 8 |
| 2.8 | 7 |
| 3.0 | 6 |
| 3.2 | 5 |
| 3.4 | 4 |
| 3.6 | 3 |
| 3.8 | 2 |
| 4.0 | 1 |
| 4.2 | 0 Black |

It can be seen that gray scale zero, driven at 4.2 volts, would produce a fairly black pixel for on-axis viewing. However, for off-axis angles of 32° or 40°, it would produce a gray scale more akin to gray scale five or six. By having this knowledge, and if it was known that the LCD would be situated at an off-axis viewing angle of for example 40°, the invention would compensate for this problem by driving some of the relevant pixels at around 2.25 volts, and some of the relevant pixels at 5.50 volts. By doing so, the viewer, from virtually any viewing angle, would perceive that portion of the LCD as reasonably black.

By spatially modulating relevant pixels in this manner, the viewer's eyes would have enough pixels operating at 2.25 volts so that the average luminance for color perceived even at 40° vertical viewing axis would be black. The remaining pixels, driven at 5.5 volts, would look very black at on-axis viewing angles.

As a second example, if a certain region of the display is desired to be red, the conventional way to accomplish this is to drive pixels having a red color filter at a relatively bright luminance to allow the back light to come through the red filters. The blue and green filtered pixels are basically driven to a low gray scale or blackened. Therefore, using the above example of gray scale and FIG. 4, it can be seen that if red pixels were driven to approximately 10% luminance at 3.25 volts, and the others driven at 4.2 volts to black, red would be accomplished in that region for on axis viewing. However, if the viewing angle was changed to 40° vertical, it can be seen that even if the blue and green pixels are driven at 4.2 volts their luminance is actually perceived almost the same as the red pixels when viewed on-axis. Therefore, the blue and green pixels now compete with the red pixels (are of similar brightness) and basically wash out the red color for the region.

By looking at FIG. 4, if red were driven to 60% luminance at 2.2 volts, at a 40° viewing angle the relative luminance of the supposedly blackend or dimmed blue and green pixels would substantially exceed the luminance of the red pixels. The color of that area would then basically reverse based on the complementary nature of red, blue, and green colors.

To solve this problem, the present invention takes into consideration the known viewing angle and drives selected sets of pixels at one voltage, and at least another selected set of pixels at another voltage. An example would be to drive one half of the pixels which are supposed to be 10% red luminance at a voltage which produces double that luminance. The other half of the red pixels would be driven at a voltage to produce no luminance of any perceivable output. The average of the two would then create the 10% luminance required.

By doing so, if one views the display on-axis, it looks appropriately red. Although only one half of the pixels have any red luminance, those pixels are at twice the required brightness which results in an average of 10% brightness for all the desired red pixels. If viewed off-axis, and assuming the luminance versus voltage curve for those particular pixels is shown in FIG. 4, the one half of the pixels driven to 20% brightness decrease in brightness substantially, for example to 4%. Because of the reversing or rebound nature of curves in FIG. 4, the one half red pixels that were driven to 0% brightness or to black, would raise in brightness to 2% brightness. The average between the two sets would then be 3% brightness which is still lower than desired, but much improved. Therefore, instead of completely losing the color or having color reversal, the red colored area is preserved.

It is to be understood that this example of spatial modulation can be utilized for both vertical and horizontal off-axis angles. The exact way in which the various sets of differently driven pixels are spatially located can be chosen as is desired. Essentially, by having a knowledge of the optical response of pixels, varied driving voltages can be chosen so that the average luminance for pixels experiencing the different driving voltages produces an acceptable visual output.

According to the present invention, once the driving voltages are selected, they are provided as a portion of the customizable ramp 98 voltage which drives the particular pixels. As previously discussed, the varying voltages can be spatially modulated by utilizing input such as the Y-row count of the scan of the LCD so that pixels in odd rows, for example, can be driven at one voltage; and pixels at even rows can be driven with another voltage.

It can therefore be seen that spatial modulation can solve color reversal or simply brightness contrast problems which occur over different viewing angles.

It is to be understood that the present invention can take many forms and embodiments. The true essence and spirit of this invention are defined in the appended claims, and is not intended that the embodiment of the invention presented herein should limit the scope thereof.

For example, an alternative to utilizing memory EPROMS as previously described would be to utilize a plurality of variable voltage inputs into a high speed multiplexer switch. In essence, a stepped customizable V (ramp) 98 could then be created without the requirement of digital memory or digital analog conversion. Thus, for example, if sixteen gray scales are desired, each of 16 different voltage generators could be used and each gray scale voltage adjusted according to choice. This system would work well for temperature compensation. However, high speed analog switches are expensive and require either a large number of buffer op-amps or else very low impedance ladder networks.

Still further, this description has only portrayed a few of the controls or inputs that could be utilized for the invention. For example, separate manual controls could be utilized to dim or brighten a number of different areas of the display. This is only dependent upon size of and availability of the components. Moreover, all sorts of customizable wave forms 98 can be generated according to any number of individual or combined parameters.

What is claimed is:

1. An apparatus to generate an adjustable voltage waveform of a constant, repeating period from which actual gray scale levels for LCD pixels, which can differ from original gray scale instructions for the LCD pixels, are selected by an active matrix LCD, the apparatus allowing LCD special effects and compensation for LCD viewing and performance problems comprising:

an active matrix LCD including a plurality of pixels each having an adjustable transmissivity proportional to a voltage potential applied across the pixel, the transmissivity varying from T-max to T-min which correlates with voltage potentials V-max to V-min, the transmissivity range being called actual gray scale, the transmissivity of an individual pixel being called actual gray scale level for the pixel, at least one LCD driver including an electrical device to set a voltage potential from one Of the adjustable voltage waveforms across each pixel, and a driver device for presenting original gray scale instructions for each pixel for a given time to the LCD display;

a display controller of the type including a data device to present data to the driver device of the LCD, the data representing the original gray scale instructions as to gray scale for individual pixels, a voltage generating means for generating the adjustable voltage waveforms separate from the data, each having a repeating constant period, and each containing a plurality of voltage potentials between V-max and V-min from which the voltage potential across each pixel can be selected, and a timing control including a timing device to correlate presentation of the data and the repeating, constant periods of the voltage waveforms to each driver of the LCD; and adjustment circuitry added to the display controller, including a modification device to operate upon the adjustable voltage waveforms and alter at least portions of some of the adjustable voltage waveforms without altering the original gray scale instructions in the corresponding data, to alter voltage potential across selected pixels of the LCD from that instructed by the original gray scale instructions;

wherein the adjustment circuitry includes a digital to analog converter, and a digital means carrying instructions to alter the repeating voltage waveform;

wherein the digital means includes an information storage means for storing predetermined values for altering the repeating voltage waveform;

wherein the information storage means includes predetermined values based on viewing angle for the LCD.

2. An apparatus to generate an adjustable voltage waveform of a constant, repeating period from which actual gravy scale levels for LCD pixels, which can differ from original gray scale instructions for the LCD pixels, are selected by an active matrix LCD, the apparatus allowing LCD special effects and compensation for LCD viewing and performance problems comprising:

an active matrix LCD including a plurality of pixels each having an adjustable transmissivity proportional to a voltage potential applied across the pixel, the transmissivity varying from T-max to T-min which correlates with voltage potentials V-max to V-min, the transmissivity range being called actual gray scale, the transmissivity of an individual pixel being called actual gray scale level for the pixel, at least one LCD driver including an electrical device to set a voltage potential from one of the adjustable voltage waveforms across each pixel, and a driver device for presenting original gray scale instructions for each pixel for a given time to the LCD display;

a display controller of the type including a data device to present data to the driver device of the LCD, the data representing the original gray scale instructions as to gray scale for individual pixels, a voltage generating means for generating the adjustable voltage waveforms-separate from the data, each having a repeating constant period, and each containing a plurality of voltage potentials between V-max and V-min from which the voltage potential across each pixel can be selected, and a timing control including a timing device to correlate presentation of the data and the repeating, constant periods of the voltage waveforms to each driver of the LCD; and adjustment circuitry added to the display controller, including a modification device to operate upon the adjustable voltage waveforms and alter at least portions of some of the adjustable voltage waveforms without altering the original gray scale instructions in the corresponding data, to alter voltage potential across selected pixels of the LCD from that instructed by the original gray scale instructions;

wherein the adjustment circuitry includes a digital to analog converter, and a digital means carrying instructions to alter the repeating voltage waveform; wherein the digital means includes an information storage means for storing predetermined values for altering the repeating voltage waveform;

wherein the adjustment circuitry includes temperature sensors and the information storage means includes predetermined values based on temperature information.

3. A means for compensating and controlling relative brightness of selected pixels of an active matrix LCD to solve off-axis viewing angle and temperature-caused brightness variations, the LCD including a plurality of pixels arranged in an array of columns and rows, an electrical device associated with each pixels to set a voltage potential across the pixel where the set voltage potential determines the transmissivity through an intended brightness of the pixel, digital data devices to receive digital gray scale instructions for each row of pixels, and conversion-devices to time and convert the digital gray scale instructions into corresponding voltage potentials across rows of pixels, a display controller including a data transfer device to send said digital gray scale instructions to the digital data devices of the LCD, a timing device to control timing for the display controller and the LCD, and a voltage waveform generator including a device to produce a repeating voltage waveform of constant period and shape used to produce the voltage potentials at the pixels, the improvement comprising:

means connected to the display controller for selectivity altering at least portions of selected repeating voltage waveforms to a shape different from the repeating voltage waveforms according to predetermined compensation and control characteristics so that voltage potentials and actual transmissivity for selected pixels are altered from voltage potentials and transmissivity that would occur if the digital gray scale instructions solely controlled voltage potentials for the selected pixels without altering the digital gray scale instructions, to achieve desired brightness compensation for at least a portion of the LCD.

4. The means of claim 3 wherein the predetermined compensation and control characteristics comprise one or more of viewing angle, temperature, and selected area dimming.

5. A method for altering an actual gray scale level from an instructed gray scale value generated by a display control for an active matrix LCD without altering the instructed gray scale value where the display control separately issues an instructed gray scale value for a pixel and a repeating voltage waveform of constant period and shape, the instructed gray scale value being correlated to a proportional gray scale voltage contained in the repeating voltage waveform generated in the display control, the proportional gray scale voltage being used to set up a voltage potential at the pixel to produce a transmissivity level through the pixel correlated to said instructed gray scale value, comprising:

determining the amount of adjustment desired between said instructed gray scale value and said actual gray scale value for the pixel, the step of determining the amount of adjustment including considering the instructed gray scale value and the transmissivity level desired through the pixel for the LCD;

generating an adjusted voltage waveform different from a selected repeating voltage waveform based on the amount of adjustment desired by changing one or more portions of the repeating voltage waveform used for the pixel; and utilizing the instructed gray scale value to select a location and corresponding voltage potential on the adjusted voltage waveform to drive the pixel to an adjusted voltage potential different from said proportional gray scale voltage to achieve the actual gray scale value and desired transmissivity level at the pixel without altering the instructed gray scale value for the pixel.

6. The method of claim 5 wherein the desired transmissivity through the pixel is determined by considering viewing angle to the portion of the LCD in which the pixel is located, and the gray scale value for the pixel is adjusted to compensate for the viewing angle.

7. The method of claim 5 wherein the desired transmissivity through the pixel is determined by considering temperature of the pixel and the gray scale value for the pixel is adjusted to compensate for the temperature.

8. The method of claim 5 wherein the desired transmissivity through the pixel is determined by considering portions of the LCD desired to be adjustably dimmed and the gray scale value for the pixel is adjusted to compensate for the dimmed portion.

9. The method of claim 5 wherein the desired transmissivity through the pixel is determined by considering viewing angles to the portion of the LCD in which the pixel is located and how different viewing angles vary the perceived brightness of the pixel, and spatially modulating the voltage potential at the pixel in comparison to surrounding pixels so that perceived brightness is averaged by the viewer to the desired gray scale.

10. An apparatus for color correction compensation for on and off-axis viewing of an area of an LCD comprising an array of pixels, the array consisting of sets of pixels having green, blue, and red filters for color reproduction purposes, the pixels being driven by a display controller of the type which includes a data device which sends to the LCD a first signal containing digital gray scale instructions for each row of pixels and a voltage generator which sends to the LCD a second signal containing a repeating voltage waveform of constant period and shape and separate from the digital gray scale instructions but correlated to a set of gray scale values and from which a correlated voltage potential for a given pixel can be selected, so that rows of pixels, each having an instructed gray scale value, are successively entered to produce a composite color graphic on the LCD comprising:

a waveform adjustment component in the display controller to vary selected repeating voltage waveforms in a spatially modulated form to in turn vary actual voltage potential for individual pixels or sets of pixels from correlated voltage potential based on an instructed gray scale values, but without altering the digital gray scale instructions, so that a viewer will average the pixels to the desired color when viewing from both on-axis and off-axis directions, the waveform adjustment component including an information storage means containing data correlated to viewing angle for pixels or sets of pixels at a portion of the LCD, data correlated to effect of viewing angle on perceived brightness for pixels or sets of pixels of said portion of the LCD, and data correlated to spatial modulation values for closely spaced pixels or sets of pixels at said portion of the LCD, the spatial modulation values comprising complimentary voltage potentials which differ in magnitude from each other and from the correlated voltage potentials based on the digital gray scale instructions for selected pixels or sets of pixels;

a presentation component to present the spatially modulated complimentary voltage potentials to alternating rows of pixels so that voltage potentials at closely spaced pixels or sets of pixels will alternate between the complimentary voltage potentials and an observer from on and off axis viewing positions will average the relative brightness of the pixels or sets of pixels in said portion of the LCD to a brightness and color approximately equivalent to that instructed by the digital gray scale instructions for said portion of the LCD.

11. A method of color correction for off-axis viewing of an LCD where color is created by providing appropriate gray scale values to each pixel in an array of closely spaced sets of blue, green, and red pixels in an area of the LCD, producing the gray scale values by issuing a first signal comprising row-by-row digital gray scale instructions from a display controller and by issuing from a voltage waveform generator a second signal comprising a repeating voltage waveform of constant period and shape having normal gray scale voltages correlated to gray scale and from which is selected actual driving voltage for each pixel based on information in the first signal, and timing presentation to the pixels of the repeating voltage waveform with each row of digital gray scale instructions, comprising:

determining the effect of off-axis viewing angle on color perceived by a viewer for the area of the LCD;

varying the actual driving voltage of selected pixels in a spatially modulated manner to cause a viewer to perceive a correct color which would be perceived as other than the correct color because of the off-axis viewing angle, by altering the shape of selected repeating voltage waveforms to cause selected rows of pixels to be provided, in said second signal a first adjusted voltage waveform having gray scale voltage magnitudes of first amounts compared to normal gray scale voltages, and to cause selected rows of pixels to be provided a second adjusted voltage waveform having gray scale voltage magnitudes of second amounts compared to normal gray scale voltages and differing from said first amounts, so that closely spaced pixels will be driven to voltage potentials which vary from one another and a viewer of said area of the LCD would average closely spaced pixels for said off-axis viewing angle to perceive the correct color as intended by the digital gray scale instructions for said area but without altering the digital gray scale instructions in said first signal.

12. The method of claim 11 wherein the variance of driving voltages is based on determining luminance versus applied voltage curves for the LCD.

13. The method of claim 12 wherein the curves represent a plot of measured brightness of a pixel for increasing applied voltage to the pixel.

14. The method of claim 13 wherein the curves indicate variance of luminance as a function of viewing angle which can be converted to a change of color between on-axis and off-axis viewing.

15. The method of claim 14 wherein the curves indicate when off-axis viewing angles cause color reversal.

16. The method of claim 11 wherein driving voltage is spatially modulated by driving two sets of pixels at different voltages, the average corresponding brightness characteristics of which are at a desired level.

17. The method of claim 11 wherein driving voltage is spatially modulated row by row of LCD.

18. An LCD controller of the type where digital data containing instructed gray scale for rows of pixels is passed in a first signal to a driver of pixels of an active matrix LCD, a voltage ramp of constant period and repeating, non-varying shape is generated and passed in a second signal to the driver of the LCD, and a timed switching component converts the digital data into analog voltages correlated to the instructed gray scale at the pixels, the improvement comprising:

a circuit added to the display controller including a component to alter selected voltage ramps in the second signal into adjusted waveforms that are altered to effect the transmittance of selected pixels or sets of pixels without altering the digital data in the first signal so that actual analog voltages set up in selected pixels differ from analog voltages that would have been set up in those pixels if the unaltered selected voltage ramps had been used, thereby compensating or altering the transmittance and actual perceived gray scale without altering the instructed gray scale in the first signal;

wherein the circuit comprises a voltage generating control producing voltage waveforms in successive equal periods timed to presentation of digital data to the LCD;

an input component presenting information to the voltage generating control which at least in part determines the voltage waveform for each successive period;

wherein the input component includes a sensing device;

wherein the sensing device is a temperature sensor.

19. An LCD controller of the type where digital data containing instructed gray scale for rows of pixels is passed in a first signal to a driver of pixels of an active matrix LCD, a voltage ramp of constant period and repeating, non-varying shape is generated and passed in a second signal to the driver of the LCD, and a timed switching component converts the digital data into analog voltages correlated to the instructed gray scale at the pixels, the improvement comprising:

a circuit added to the display controller including a component to alter selected voltage ramps in the second signal into adjusted waveforms that are altered to effect the transmittance of selected pixels or sets of pixels without altering the digital data in the first signal so that actual analog voltages set up in selected pixels differ from analog voltages that would have been set up in those pixels if the unaltered selected voltage ramps had been used, thereby compensating or altering the transmittance and actual perceived gray scale without altering the instructed gray scale in the first signal;

wherein the circuit comprises a voltage generating control producing voltage waveforms in successive equal periods, timed to presentation of digital data to the LCD;

an input component presenting information to the voltage generating control which at least in part determines the voltage waveform for each successive period;

wherein the input component includes a sensing device:

wherein the sensing device is a view angle sensor.

20. An LCD controller of the type where digital data containing instructed gray scale for rows of pixels is passed in a first signal to a driver of pixels of an active matrix LCD, a voltage ramp of constant period and repeating, non-varying shape is generated and passed in a second signal to the driver of the LCD and a timed switching component converts the digital data into analog voltages correlated to the instructed gray scale at the pixels, the improvement comprising:

a circuit added to the display controller including a component to alter selected voltage ramps in the second signal into adjusted waveforms that are altered to effect the transmittance of selected pixels or sets of pixels without altering the digital data in the first signal so that actual analog voltages set up in selected pixels differ from analog voltages that would have been set up in those pixels if the unaltered selected voltage ramps had been used, thereby compensating or altering the transmittance and actual perceived gray scale without altering the instructed gray scale in the first signal;

wherein the circuit comprises a voltage generating control producing voltage waveforms in successive equal periods timed to presentation of digital data to the LCD;

an input component presenting information to the voltage generating control which at least in part determines the voltage waveform for each successive period;

wherein the input component includes a manipulatable control.

21. The controller of claim 20 wherein the manipulatable control is a dimming adjustment control.

22. The controller of claim 20 wherein the manipulatable control is a brightness control.

23. An LCD controller of the type where digital data containing instructed gray scale for rows of pixels is passed in a first signal to a driver of pixels of an active matrix LCD, a voltage ramp of constant period and repeating, non-varying shape is generated and passed in a second signal to the driver of the LCD, and a timed switching component converts the digital data into analog voltages correlated to the instructed gray scale at the pixels, the improvement comprising:

a circuit added to the display controller including a component to alter selected voltage ramps in the second signal into adjusted waveforms that are altered to effect the transmittance of selected pixels or sets of pixels without altering the digital data in the first signal so that actual analog voltages set up in selected pixels differ from analog voltages that would have been set up in those pixels if the unaltered selected voltage ramps had been used, thereby compensating or altering the transmittance and actual perceived gray scale without altering the instructed gray scale in the first signal;

wherein the circuit comprises a voltage generating control producing voltage waveforms in successive equal periods timed to presentation of digital data to the LCD;

an input component presenting information to the voltage generating control which at least in part determines the voltage waveform for each successive period;

wherein the input component includes an information device;

wherein the information device is a component containing information relating to view angle.

24. An LCD controller of the type where digital data containing instructed gray scale for rows of pixels is passed in a first signal to a driver of pixels of an active matrix LCD, a voltage ramp of constant period and repeating, non-varying shape is generated and passed in a second signal to the driver of the LCD, and a timed switching component converts the digital data into analog voltages correlated to the instructed gray scale at the pixels, the improvement comprising:

a circuit added to the display controller including a component to alter selected voltage ramps in the second signal into adjusted waveforms that are altered to effect the transmittance of selected pixels or sets of pixels without altering the digital data in the first signal so that actual analog voltages set up in selected pixels differ from analog voltages that would have been set up in those pixels if the unaltered selected voltage ramps had been used, thereby compensating or altering the transmittance and actual perceived gray scale without altering the instructed gray scale in the first signal;

wherein the circuit comprises a voltage generating control producing voltage waveforms in successive equal periods timed to presentation of digital data to the LCD;

an input component presenting information to the voltage generating control which at least in part determines the voltage waveform for each successive period;

wherein the input component includes an information device;

wherein the information device is a component containing information relating to background brightness.

25. An LCD controller of the type where digital data containing instructed gray scale for rows of pixels is passed in a first signal to a driver of pixels of an active matrix LCD, a voltage ramp of constant period and repeating, non-varying shape is generated and passed in a second signal to the driver of the LCD, and a timed switching component converts the digital data into analog voltages correlated to the instructed gray scale at the pixels, the improvement comprising:

a circuit added to the display controller including a component to alter selected voltage ramps in the second signal into adjusted waveforms that are altered to effect the transmittance of selected pixels or sets of pixels without altering the digital data in the first signal so that actual analog voltages set up in selected pixels differ from analog voltages that would have been set up in those pixels if the unaltered selected voltage ramps had been used, thereby compensating or altering the transmittance and actual perceived gray scale without altering the instructed gray scale in the first signal;

wherein the circuit comprises a voltage generating control producing voltage waveforms in successive equal periods timed to presentation of digital data to the LCD;

an input component presenting information to the voltage generating control which at least in part determines the voltage waveform for each successive period;

wherein the input component includes an information device;

wherein the information device is a component containing information regarding transmissivity relative to temperature.

26. An LCD controller of the type where digital data containing instructed gray scale for rows of pixels is passed in a first signal to a driver of pixels of an active matrix LCD, a voltage ramp of constant period and repeating, non-varying shape is generated and passed in a second signal to the driver of the LCD, and a timed switching component converts the digital data into analog voltages correlated to the instructed gray scale at the pixels, the improvement comprising:

a circuit added to the display controller including a component to alter selected voltage ramps in the second signal into adjusted waveforms that are altered to effect the transmittance of selected pixels or sets of pixels without altering the digital data in the first signal so that actual analog voltages set up in selected pixels differ from analog voltages that would have been set up in those pixels if the unaltered selected voltage ramps had been used, thereby compensating or altering the transmittance and actual perceived gray scale without altering the instructed gray scale in the first signal;

wherein the circuit comprises a voltage generating control producing voltage waveforms in successive equal periods timed to presentation of digital data to the LCD;

an input component presenting information to the voltage generating control which at least in part determines the voltage waveform for each successive period;

wherein the input component includes an information device;

wherein the information device is a component containing information relating to complimentary colors.

27. An LCD controller of the type where digital data containing instructed gray scale for rows of pixels is passed in a first signal to a driver of pixels of an active matrix LCD, a voltage ramp of constant period and repeating, non-varying shape is generated and passed in a second signal to the driver of the LCD, and a timed switching component converts the digital data into analog voltages correlated to the instructed gray scale at the pixels, the improvement comprising:

a circuit added to the display, controller including a component to alter selected voltage ramps in the second signal into adjusted waveforms that are altered to effect the transmittance of selected pixels or sets of pixels without altering the digital data in the first signal so that actual analog voltages set up in selected pixels differ from analog voltages that would have been set up in those pixels if the unaltered selected voltage ramps had been used, thereby compensating or altering the transmittance and actual perceived gray scale without altering the instructed gray scale in the first signal;

wherein the circuit comprises a voltage generating control producing voltage waveforms in successive equal periods timed to presentation of digital data to the LCD;

an input component presenting information to the voltage generating control which at least in part determines the voltage waveform for each successive period;

wherein the input component includes an information device;

wherein the information device contains information relating to spatial averaging of pixel transmissivity.

28. A method for selectivity adjusting actual perceived gray scale for a set of pixels of an LCD in a LCD apparatus which includes a display controller which passes digital instructed gray scale values in a first signal to a driver for the LCD and generates a repeating, non-varying linear voltage ramp in a second signal that is made available to each of the pixels of the LCD, so that the instructed gray scale value for each refresh time for the LCD for each pixel is picked from a correlated position along the repeating non-varying voltage ramp to present a known correlated voltage based on the instructed gray scale value to each pixel, comprising:

determining desired adjustment of actual perceived gray scale to the set of pixels;

passing the digital data in the first signal of the display controller containing the instructed gray scale values to the LCD without modification;

modifying at least one repeating non-varying voltage ramp in the second signal of the display controller into an adjusted voltage waveform of equal period to the voltage ramp, making the adjusted voltage waveform available to each of the pixels, and correlating its presentation to the set of pixels in a form and at a time needed to vary the voltage and the actual perceived gray scale at selected pixels of the set of pixels;

wherein the voltage ramp is adjusted to alter presentation of the voltage to pixels at a selected portion of the LCD based on information related to viewing angle to the LCD.

29. A method for selectivity adjusting actual perceived gray scale for a set of pixels of an LCD in a LCD apparatus which includes a display controller which passes digital instructed gray scale values in a first signal to a driver for the LCD and generates a repeating, non-varying linear voltage ramp in a second signal that is made available to each of the pixels of the LCD, so that the instructed gray scale value for each refresh time for the LCD for each pixel is picked from a correlated position along the repeating non-varying voltage ramp to present a known correlated voltage based on the instructed gray scale value to each pixel, comprising:

determining desired adjustment of actual perceived gray scale to the set of pixels;

passing the digital data in the first signal of the display controller containing the instructed gray scale values to the LCD without modification;

modifying at least one repeating non-varying voltage ramp in the second signal of the display controller into an adjusted voltage waveform of equal period to the voltage ramp, making the adjusted voltage waveform available to each of the pixels, and correlating its presentation, to the set of pixels in a form and at a time needed to vary the voltage and the actual perceived gray scale at selected pixels of the set of pixels;

wherein the voltage ramp is adjusted based on information regarding temperature at or near the LCD.

30. A method for selectivity adjusting actual perceived gray scale for a set of pixels of an LCD in a LCD apparatus which includes a display controller which passes digital instructed gray scale values in a first signal to a driver for the LCD and generates a repeating, non-varying linear voltage ramp in a second signal that is made available to each of the pixels of the LCD, so that the instructed gray scale value for each refresh time for the LCD for each pixel is picked from a correlated position along the repeating non-varying voltage ramp to present a known correlated voltage based on the instructed gray scale value to each pixel, comprising:

determining desired adjustment of actual perceived gray scale to the set of pixels;

passing the digital data in the first signal of the display controller containing the instructed gray scale values to the LCD without modification;

modifying at least one repeating non-varying voltage ramp in the second signal of the display controller into an adjusted voltage waveform of equal period to the voltage ramp, making the adjusted voltage waveform available to each of the pixels, and correlating its presentation to the set of pixels in a form and at a time needed to vary the voltage and the actual perceived gray scale at selected pixels of the set of pixels;

wherein the voltage ramp is adjusted based on desired change in intensity of selected portions of the LCD.

* * * * *